US012065883B2

(12) United States Patent
McDonough et al.

(10) Patent No.: US 12,065,883 B2
(45) Date of Patent: Aug. 20, 2024

(54) HYBRID BIT

(71) Applicant: Schlumberger Technology Corporation, Sugar Land, TX (US)

(72) Inventors: Scott D. McDonough, The Woodlands, TX (US); Venkatesh Karuppiah, The Woodlands, TX (US); Mahesha Kumar, Cypress, TX (US); Shelton Alsup, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/247,111

(22) PCT Filed: Sep. 28, 2021

(86) PCT No.: PCT/US2021/052448
§ 371 (c)(1),
(2) Date: Mar. 29, 2023

(87) PCT Pub. No.: WO2022/072369
PCT Pub. Date: Apr. 7, 2022

(65) Prior Publication Data

US 2023/0374865 A1 Nov. 23, 2023

Related U.S. Application Data

(60) Provisional application No. 63/084,967, filed on Sep. 29, 2020.

(51) Int. Cl.
*E21B 10/25* (2006.01)
*E21B 10/14* (2006.01)

(52) U.S. Cl.
CPC ..... *E21B 10/25* (2013.01); *E21B 10/14* (2013.01)

(58) Field of Classification Search
CPC ..... E21B 10/25; E21B 10/14; E21B 10/5673
See application file for complete search history.

(56) References Cited

U.S. PATENT DOCUMENTS 2,117,481 A 5/1938 Howard
2,192,697 A * 3/1940 Scott ..... E21B 10/20 384/96
2,320,136 A 5/1943 Kammerer
(Continued)

FOREIGN PATENT DOCUMENTS

CN 1727634 A 2/2006
CN 101886522 11/2010
(Continued)

OTHER PUBLICATIONS

Office Action issued in U.S. Appl. No. 17/595,569 dated Jul. 18, 2023, 17 pages.
International Search Report and Written Opinion issued in International Patent application PCT/US2020/033989 on Sep. 1, 2020, 14 pages.
International Preliminary Report on Patentability issued in International Patent application PCT/US2020/033989 dated Dec. 2, 2021, 11 pages.
Dolezal et al., "Expansion of Field Testing and Application of New Hybrid Drill Bit." SPE 146737. Denver, Colorado, Nov. 2011, 12 pages.
(Continued)

*Primary Examiner* — Steven A Macdonald
(74) *Attorney, Agent, or Firm* — Jeffrey D. Frantz

(57) ABSTRACT

A hybrid bit includes fixed blades and wheel support structures. The wheel support structure includes a wheel inserted into a slot between a leading support and a trailing support. One or more shims fill a gap between a flange and the leading supports. An elongated seal between the wheel and the supports is provided to seal the wheel support.

19 Claims, 15 Drawing Sheets

(56) References Cited

U.S. PATENT DOCUMENTS 2,520,517 A 8/1950 Taylor
2,725,215 A 11/1955 Macneir
2,877,988 A 3/1959 Cameron
3,055,443 A 9/1962 Edwards
3,870,370 A * 3/1975 Winberg ..... E21B 10/10 175/413
4,006,788 A 2/1977 Garner
4,203,496 A 5/1980 Baker, III
4,285,409 A 8/1981 Allen
4,343,371 A 8/1982 Baker, III
4,359,112 A 11/1982 Garner
4,444,281 A 4/1984 Schumacher, Jr.
4,448,269 A 5/1984 Ishikawa
4,892,159 A 1/1990 Holster
5,024,539 A * 6/1991 Vezirian ..... E21B 10/25 384/94
5,145,017 A 9/1992 Holster
5,176,212 A 1/1993 Tandberg
5,626,201 A * 5/1997 Friant ..... E21B 10/22 175/373
5,695,019 A 12/1997 Shamburger, Jr.
5,862,871 A 1/1999 Curlett
5,904,211 A * 5/1999 Friant ..... E21D 9/0879 175/371
6,345,673 B1 2/2002 Siracki
6,439,326 B1 8/2002 Huang
6,561,291 B2 5/2003 Xiang
6,688,410 B1 2/2004 Singh
6,786,288 B2 9/2004 Singh
6,863,138 B2 3/2005 Siracki
7,059,430 B2 6/2006 Singh
7,341,119 B2 3/2008 Singh
7,819,208 B2 10/2010 Pessier
7,841,426 B2 11/2010 Zahradnik
7,845,435 B2 12/2010 Zahradnik
8,047,307 B2 11/2011 Pessier
8,082,134 B2 12/2011 Huang
8,141,664 B2 3/2012 Zahradnik
8,157,026 B2 4/2012 Kulkarni
8,336,646 B2 12/2012 Kulkarni
8,356,398 B2 1/2013 McCormick
8,459,378 B2 6/2013 Zahradnik
8,550,190 B2 10/2013 Hall et al.
8,672,060 B2 3/2014 Centala
8,678,111 B2 3/2014 Zahradnik
8,881,848 B2 11/2014 Knull
8,950,514 B2 2/2015 Buske
8,955,413 B2 2/2015 Bijai
8,985,243 B2 * 3/2015 Yang ..... E21B 10/14 175/336
9,004,198 B2 4/2015 Kulkarni
9,033,069 B2 5/2015 Zhang
9,103,168 B2 8/2015 Yang
9,212,523 B2 12/2015 Yong
9,353,575 B2 5/2016 Zahradnik
9,428,965 B2 8/2016 Jones
9,556,681 B2 1/2017 Kulkarni
9,574,405 B2 2/2017 Cariveau
9,657,527 B2 5/2017 Buske
9,670,736 B2 6/2017 Zahradnik
9,850,716 B2 12/2017 Lin
9,976,353 B2 5/2018 Hinz
10,066,439 B2 9/2018 Hinz
10,072,462 B2 9/2018 Zahradnik
10,100,581 B1 10/2018 Timte
10,107,040 B2 10/2018 Evans
10,156,099 B2 12/2018 Do
10,190,366 B2 1/2019 Zahradnik
10,352,101 B2 7/2019 Yang
10,704,330 B2 7/2020 Clausen
10,731,420 B2 8/2020 Dahlgren
10,988,988 B2 4/2021 Clausen
2003/0136588 A1 7/2003 Truax
2005/0274550 A1 * 12/2005 Yu ..... F16J 15/344 175/372
2007/0131457 A1 6/2007 McDonough
2008/0099244 A1 * 5/2008 Chellappa ..... E21B 10/25 175/371
2008/0264695 A1 * 10/2008 Zahradnik ..... E21B 10/14 175/336
2009/0159338 A1 6/2009 Buske
2010/0025119 A1 2/2010 Stauffer
2010/0155146 A1 6/2010 Nguyen
2010/0288561 A1 11/2010 Zahradnik
2012/0111638 A1 5/2012 Nguyen
2012/0130685 A1 5/2012 Huang
2012/0205160 A1 8/2012 Ricks
2013/0098688 A1 4/2013 Yong
2013/0126247 A1 * 5/2013 Yang ..... E21B 10/14 175/374
2014/0151131 A1 6/2014 Zahradnik
2014/0196956 A1 7/2014 Centala
2014/0202771 A1 7/2014 Zahradnik
2014/0202774 A1 7/2014 Bowden
2014/0353046 A1 12/2014 Zhang
2015/0075873 A1 3/2015 Jones
2015/0090501 A1 4/2015 King
2015/0152687 A1 6/2015 Nguyen
2015/0197992 A1 7/2015 Ricks
2015/0211303 A1 7/2015 Buske
2015/0285003 A1 10/2015 Kulkarni
2015/0337603 A1 11/2015 Schroder
2015/0368977 A1 12/2015 Yang
2016/0108680 A1 4/2016 Rothe
2016/0230467 A1 8/2016 Zahradnik
2016/0230468 A1 8/2016 Ricks
2016/0237752 A1 8/2016 Jones
2016/0251902 A1 9/2016 Zahradnik
2016/0319602 A1 11/2016 Zhang
2016/0348440 A1 12/2016 Gan
2017/0058609 A1 3/2017 Chen
2017/0167201 A1 6/2017 Clausen
2018/0087323 A1 3/2018 Dahlgren
2018/0298696 A1 10/2018 Barry
2019/0277093 A1 9/2019 Morin
2022/0220807 A1 7/2022 McDonough

FOREIGN PATENT DOCUMENTS

CN 101892810 11/2010
CN 201751525 2/2011
CN 102392603 3/2012
CN 102392605 A 3/2012
CN 102400646 4/2012
CN 102434105 5/2012
CN 202220555 5/2012
CN 102561953 7/2012
CN 103015899 4/2013
CN 103089154 5/2013
CN 103089156 5/2013
CN 103147691 6/2013
CN 203201474 9/2013
CN 203201475 9/2013
CN 103742077 A 4/2014
CN 103758457 4/2014
CN 103758458 4/2014
CN 103939022 7/2014
CN 105113995 A 12/2015
CN 105649536 A 6/2016
CN 105804663 7/2016
CN 106014266 10/2016
CN 106320989 A 1/2017
CN 205876191 1/2017
CN 205876194 1/2017
CN 106382098 2/2017
CN 106437525 2/2017
CN 206129165 4/2017
CN 106639886 A 5/2017
CN 206190213 U 5/2017
CN 206190217 5/2017
CN 106869802 A 6/2017

(56) References Cited

FOREIGN PATENT DOCUMENTS

| | | | |
|---|---|---|---|
| CN | 206220857 | | 6/2017 |
| CN | 107060653 | A | 8/2017 |
| CN | 206655657 | | 11/2017 |
| CN | 207048679 | | 2/2018 |
| CN | 207048684 | | 2/2018 |
| CN | 207420457 | | 5/2018 |
| CN | 207553972 | | 6/2018 |
| CN | 108798514 | A | 11/2018 |
| CN | 108868622 | | 11/2018 |
| CN | 108868625 | A | 11/2018 |
| IN | 206174872 | | 5/2017 |
| WO | 2015179792 | A3 | 1/2016 |
| WO | 2019035838 | A1 | 2/2019 |

OTHER PUBLICATIONS

Pessier et al., "Hybrid Bits Offer Distinct Advantages in Selected Roller-Cone and PDC-Bit Applications." SPE 128741 Drilling Completion. Mar. 2011, 8 pages.

International Search Report and Written Opinion issued in International Patent application PCT/US2021/052448 on Jan. 14, 2022, 10 pages.

International Preliminary Report on Patentability issued in International Patent application PCT/US2021/052448 dated Apr. 13, 2023, 9 pages.

* cited by examiner

HYBRID BIT

CROSS-REFERENCE TO RELATED APPLICATIONS

This application is the National Stage Entry of International Application No. PCT/US2021/052448, filed Sep. 28, 2021, which claims priority to, and the benefit of, U.S. Patent Application No. 63/084,967 filed Sep. 29, 2020, which is expressly incorporated herein by this reference in its entirety.

BACKGROUND OF THE DISCLOSURE

Downhole drilling operations use a bit to remove formation material. A fixed blade bit includes fixed blades having connected cutting elements that drag along the ground as the bit is rotated to break up the formation. A rotary bit includes one or more wheels having cutting elements that contact the formation. As the rotary bit is rotated, the contact of the cutting elements with the formation may cause the wheel to rotate independently of the bit. Hybrid bits include elements of both fixed blade bits and rotary bits.

SUMMARY

In some embodiments, a method for manufacturing a bit includes providing a bit body having a fixed blade and a wheel support structure. The wheel support structure defines a wheel slot therebetween. A wheel is provided having a plurality of cutting elements. A first flange is inserted into the wheel support structure and a wheel is inserted into the wheel slot. With the wheel in the wheel slot, a separation distance is measured between the first flange and the wheel support structure. The wheel is removed and at least one shim is added between the first flange and the wheel support structure. After adding the shim, the first flange is inserted into the wheel support structure, and the wheel is inserted into the wheel slot.

In some embodiments, a hybrid bit includes a plurality of fixed blades, a first support with a first journal bore, a second support with a second journal bore aligned with the first journal bore, a first flange inserted into the first journal bore, and a shim between the first flange and the first journal bore. The hybrid bit includes wheel located between the first support and the second support. The wheel includes a seal gland, and an elongated seal is located in the seal gland.

In some embodiments, a hybrid bit includes a plurality of fixed blades. A first support includes a first journal bore. A second support includes a second journal bore, the first support and the second support defining a wheel slot. A wheel is located between the first support and the second support in the wheel slot. The wheel includes a cutting element having a tip. A slot base extends to a central nozzle in the wheel slot. The slot base is offset from the tip of the cutting element with an offset of less than 0.50 in. (12.7 mm). At a central nozzle, the wheel slot has a wheel slot depth that is greater than or equal to a wheel diameter of the wheel. In some embodiments, a shim is installed between a first flange and the first support. In some embodiments, the wheel includes an elongate seal.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a representation of a perspective view of a hybrid bit, according to at least one embodiment of the present disclosure;

FIG. 2-2 is a representation of a bottom view of the hybrid bit of FIG. 2-1;

FIG. 2-3 is a representation of a close-up portion of the bottom view of FIG. 2-2;

FIG. 2-4 is a representation of a side view of the bit head of the hybrid bit of FIG. 2-1;

FIG. 3 is a representation of a cross-sectional view of a wheel support structure, according to at least one embodiment of the present disclosure;

FIG. 4 is a representation of a cutting element profile, according to at least one embodiment of the present disclosure;

FIG. 8-1 through FIG. 8-4 are representations of an assembly of a wheel support structure, according to at least one embodiment of the present disclosure.

DETAILED DESCRIPTION

This disclosure generally relates to devices, systems, and methods for a hybrid bit. Hybrid bits according to embodiments of the present disclosure may include a wheel mount that has a leading support and a trailing support which form a wheel slot between them. To assemble the bit, a leading support flange is inserted into a leading bore in the leading support and a trailing support flange is inserted into the trailing bore. The wheel is inserted into the wheel slot, and the journal shaft is inserted to maintain position of the wheel. A biasing force is applied to the wheel to push the wheel and the leading flange support toward the trailing flange. A separation distance between the leading flange and the leading support is measured. The journal shaft, wheel, and leading support flange are then removed, and shims equal to the separation distance are inserted on the leading support flange. The leading support flange is installed in the leading support with the shims between the leading support flange and the leading support. One or more elongate seals are then installed in the wheel, the wheel is inserted radially into the wheel slot, and the journal shaft is inserted through the wheel.

Figure 1:
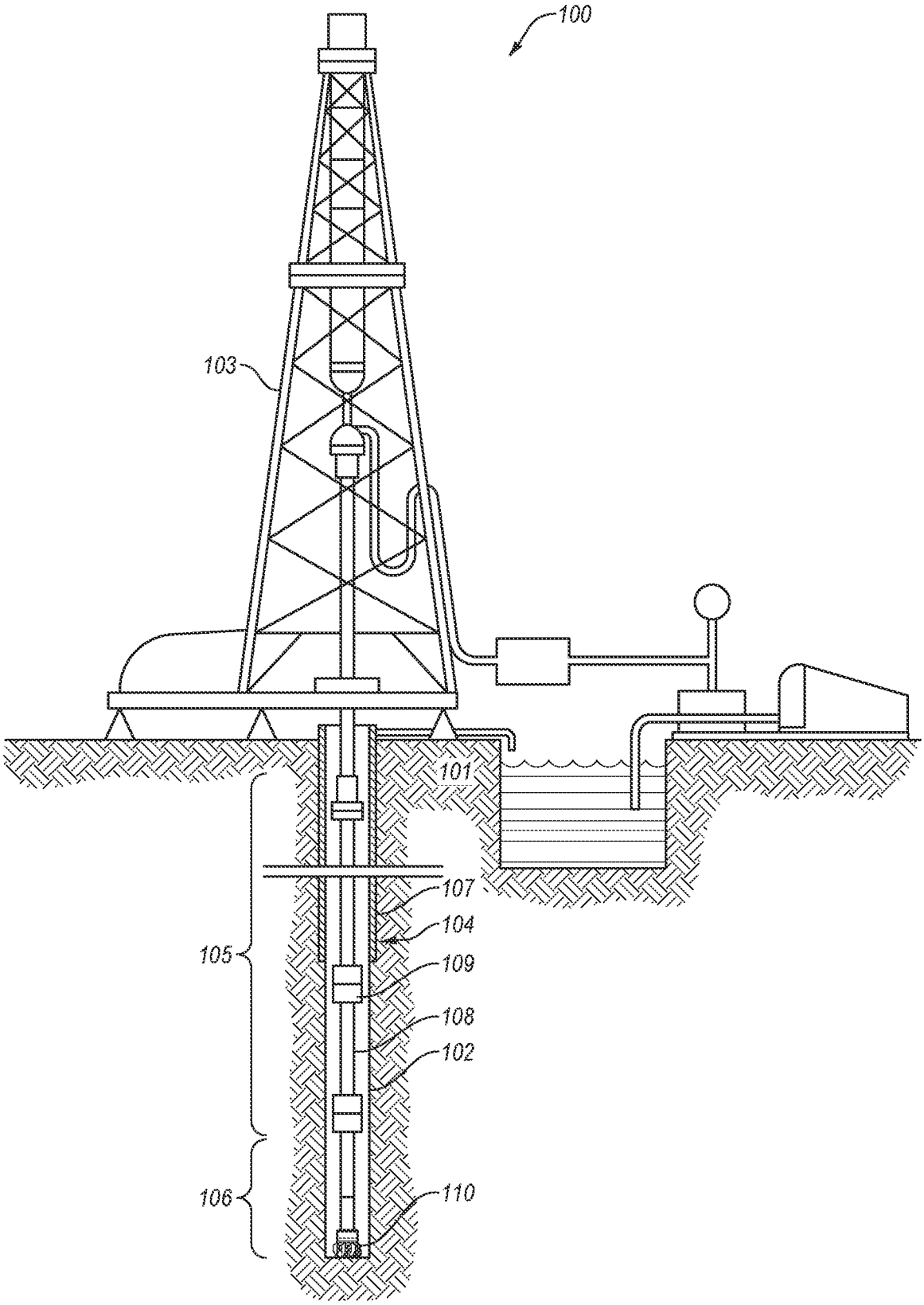
FIG. 1 is a representation of a drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In accordance with embodiments of the present disclosure, the BHA 106 may include any drilling and/or steering system. For example, the BHA 106 may include an RSS, as discussed above. In some examples, the BHA 106 may include a portion of a sub that is bent and used to steer the bit 110. In some examples, the BHA 106 may include a slide drilling steering system. In some embodiments, the BHA 106 may include a downhole motor that generates power, such as electric or mechanical power. In some embodiments, the downhole motor may provide power for downhole systems, such as sensors or other power-based systems. In some embodiments, the downhole motor may provide rotary power to rotate the bit 110.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figures 1, 2:
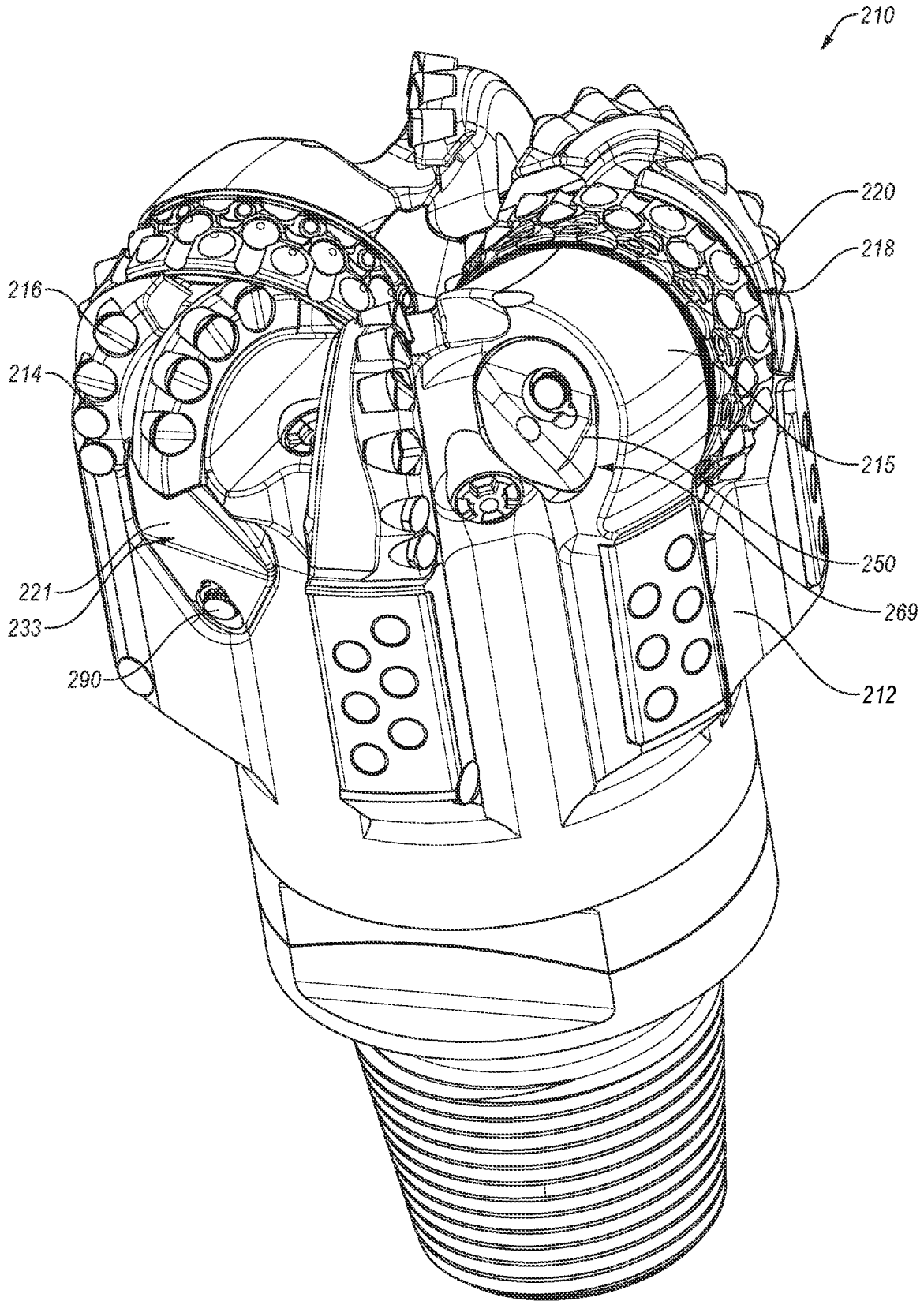
Figure 2:
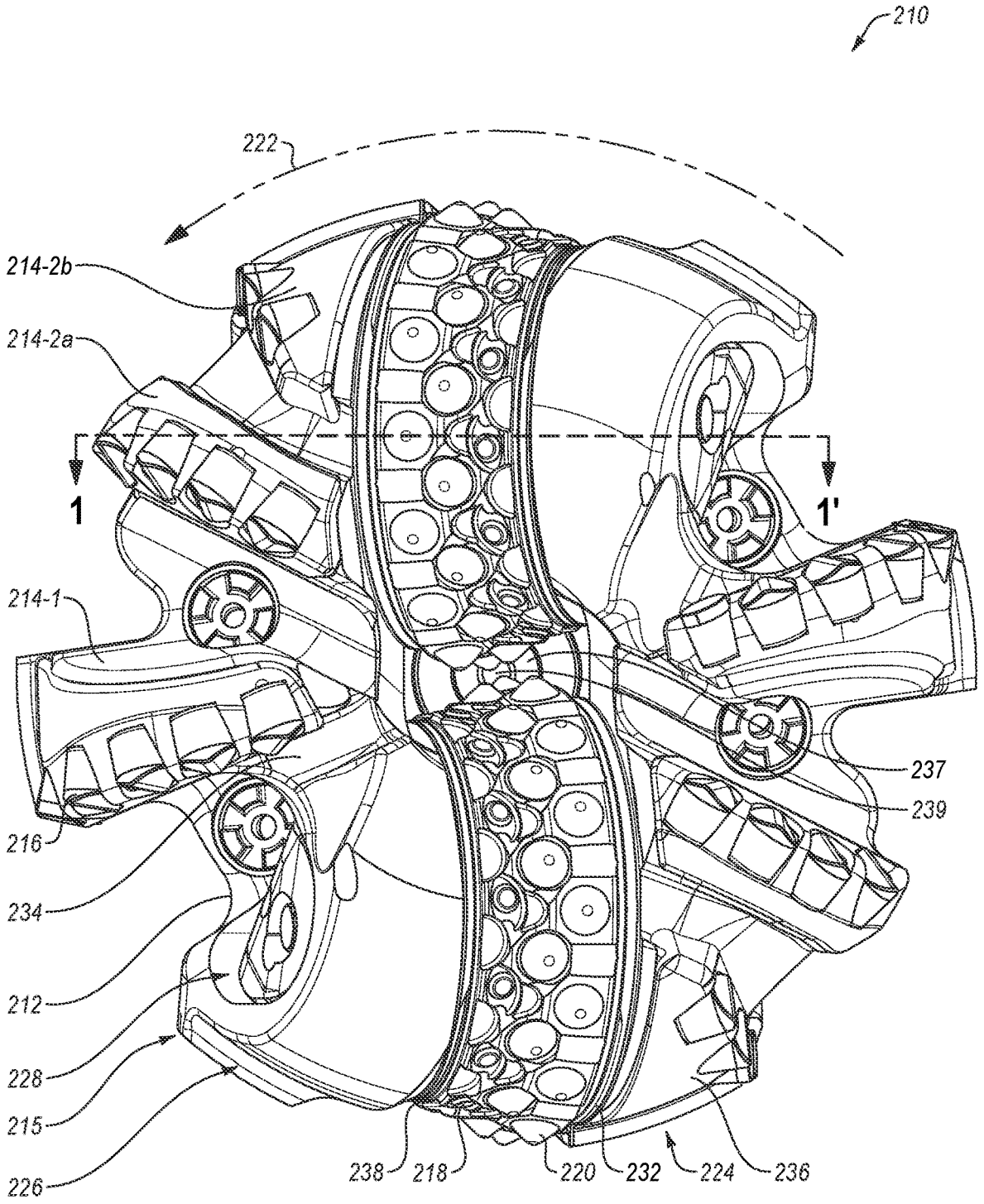

FIG. 2-1 is a perspective view of an embodiment of a bit 210. The bit 210 may include a body 212 from which a plurality of blades 214 may protrude in radial and axial directions. The bit 210 may include a combination of at least one fixed blade 214 and at least one wheel support structure 215. Thus, the bit 210 may be a hybrid bit. The fixed blade 214 of the hybrid bit may include fixed blade cutting elements 216 that maintain a position relative to the body 212 during drilling operations. The hybrid bit shown includes a wheel support structure 215 which includes a wheel 218 having one or more wheel cutting elements 220. As the bit 210 rotates, the wheel 218 may rotate about an axis relative to the body 212. Thus, the wheel cutting elements 220 may change position relative to the body 212 during drilling operations. In some embodiments, a blade 214 may include fixed blade cutting elements 216 and a wheel 218 having wheel cutting elements 220. Because of the combination of fixed blades 214 and wheel support structures 215, a hybrid bit may experience an increased rate of penetration and/or experience a longer operational life and/or yield an improved tool face control for the BHA (e.g., BHA 106 of FIG. 1) and/or the entire drilling system (e.g., drilling tool assembly 104 of FIG. 1).

In some embodiments, the fixed blade cutting elements 216 may be a planar cutting element, such as a shear cutting element. In some embodiments, the wheel cutting elements 220 may include one or more planar cutting elements, such as shear cutting elements. In some embodiments, the fixed blade cutting elements 216 and/or the wheel cutting elements 220 may include a non-planar cutting element. In some embodiments, the fixed blade cutting elements 216 and/or the wheel cutting elements 220 may be a conical cutting element. In some embodiments, the fixed blade cutting elements 216 and/or the wheel cutting elements 220 may be any type of cutting elements. The wheel cutting elements 220 may be disposed on a circumferentially outer surface of the wheel 218. In some embodiments, the axis of one or more of the wheel cutting elements 220 may extend in a generally radial direction from the wheel 218. Moreover, in some embodiments the axis of the one or more wheel cutting elements 220 may extend in a general radial direction and toward either a leading surface of the wheel 218 or a trailing surface of the wheel 218.

In some embodiments, each fixed blade cutting element 216 may be the same. In some embodiments, different fixed blades 214 may include different fixed blade cutting elements 216, different sized cutting elements 216, and different arrangements of cutting elements 216, or any combination thereof. The fixed blade cutting elements 216 may be arranged among the fixed blades 214 in a forward spiral, a reverse spiral, or in a star pattern. In a star pattern, the cutting elements 216 may be arranged on the fixed blades 214 in a radial sequence out from the bit axis 239 that connects cutting elements that are the most distant in a circumferential direction, such that the sequence that may progress in a forward direction, a reverse direction, or a combination thereof among different fixed blades 214. Arrangements of the fixed cutting elements 216 in a star pattern may reduce differential loading on the fixed cutting elements 216 that may otherwise occur due to circumferential spacing differences between the fixed blades 214 of the bit 210. In some embodiments, a single fixed blade 214 may include different fixed blade cutting elements 216 (e.g., planar and non-planar; multiple non-planar geometries). In some embodiments, each wheel cutting element 220 may be the same. In some embodiments, different wheels 218 may include different wheel cutting elements 220. In some embodiments, a single wheel 218 may include different cutting elements. In some embodiments, the fixed blade cutting elements 216 may be the same as the wheel cutting elements 220. In some embodiments, the fixed blade cutting elements 216 may be different from the wheel cutting elements 220.

The wheel 218 is supported by a journal shaft. In some embodiments, a cover 221 on a leading face 233 of the wheel support structure 215 covers and/or supports the journal shaft that extends at least partially through the wheel support structure 215. The cover 221 may at least partially protect the journal shaft and a leading support flange from mud or cuttings infiltration during operation. In some embodiments, a trailing support member 250 that supports a trailing end of the journal shaft within the wheel support structure 215 may be exposed on a trailing face 269 of the wheel support structure 215. In some embodiments, the leading face 233 and/or the trailing face 269 may have an asymmetric (e.g., not circular) shape. The cavity through the wheel support structure 215 may have an asymmetric shape although the journal shaft and wheel 215 may rotate about a fixed axis through the cavity, as discussed below. An asymmetric shape of at least a portion of the cover 221 may facilitate resistance of rotational forces and/or torques caused by rotation of the wheel 218. The journal shaft may be connected to the cover 221 and/or to support flanges of the wheel support structure 215 with asymmetric features as shown in FIG. 2-1 to reduce or eliminate loosening during operation. For example, the journal bolt 290 may reduce rotation of the cover 221 within the cavity through the wheel support structure 215.

FIG. 2-2 is a representation of a bottom of the bit 210 of FIG. 2-1. The bit 210 shown includes two primary fixed blades 214-1 and two secondary fixed blades (generally 214-2). The primary fixed blades 214-1 may have cutting elements 216 arranged in the nose region, the shoulder region, and the gauge region of the bit 210. In some embodiments, the secondary fixed blades 214-2 may include multiple sections that are adjacent a leading face of the wheel 218 (e.g., the secondary fixed blade 214-2 may be a split-blade split into a first section 214-2*a* and a second section 214-2*b*). For example, the secondary fixed blade 214-2 includes a first section 214-2*a* and a second section 214-2*b*. The second section 214-2*b* may be located adjacent the leading face of the wheel 218, and the first section 214-2*a* may be located between the primary fixed blade 214-1 and the second section 214-2*b*. In some embodiments, both the first section 214-2*a* and the second section 214-2*b* are adjacent to the wheel 218. In some embodiments, the cutting elements 216 of the first section 214-2*a* may be arranged in a nose region and shoulder region of the bit 210, and the cutting elements 216 of the second section 214-2*b* may be arranged in a shoulder region and a gauge region of the bit 210. The bit 210 further includes two wheel support structures 215, each including a wheel 218. The bit 210 is configured to rotate with a bit direction of rotation 222. Each wheel support structure 215 includes a wheel mount. The wheel mount may be the portion of the wheel support structure 215 to which the wheel 218 is connected and/or the portion of the wheel support structure 215 through which a journal shaft through the wheel 218 is supported. In some embodiments, at least a portion of the wheel mount may be located on a fixed blade 214. The wheel mount may include a leading support 224 and a trailing support 226. The leading support 224 may be located rotationally ahead of the trailing support 226 as the bit 210 is rotated in the bit direction of rotation.

In the embodiment shown, the leading support 224 includes fixed blade cutting elements on a leading support cutter block 236. The fixed blade cutting elements 216 on the leading support cutter block 236 may help to remove the formation before the wheel 218 reaches the formation, thereby reducing the forces on the wheel 218. In some embodiments, one or more fixed blade cutting elements may be installed on the trailing support 226. In some embodiments, the leading support 224 may be a fixed blade 214 and/or part of a fixed blade 214 (such as the second section 214-2*b* of the secondary fixed blade 214-2) having fixed blade cutting elements on the cutter block 236. The wheel 218 may be at least partially supported by the fixed blade leading support 224 and by the trailing support 226.

In the embodiment shown, the bit 210 has symmetric spacing of blades 214. For example, the primary fixed blades 214-1 are spaced 180° apart, the secondary fixed blades 214-2 are spaced 180° apart, and the wheel support structures 215 are spaced 180° apart. In some embodiments, the bit 210 may include asymmetric spacing (e.g., the circumferential spacing of two blades 214 with similar radial lengths may be different around the circumference of the bit 210) of the blades 214. For example, the blades 214 may have non-axisymmetric (e.g., non-symmetric about the rotational axis) circumferential spacing. In some embodiments, the circumferential spacing may be in a range having an upper value, a lower value, or upper and lower values including any of 150°, 155°, 160°, 165°, 170°, 175°, 180°, 185°, 190°, 195°, 200°, 205°, 210°, or any value therebetween. For example, the circumferential spacing may be greater than 150°. In another example, the circumferential spacing may be less than 210°. In yet other examples, the circumferential spacing may be any value in a range between 150° and 210°. In some embodiments, it may be critical that the circumferential spacing is non-axisymmetric between 150° and 210° to improve stability of the bit.

In some embodiments, a wheel support 228 may extend through the trailing support 226 and into the leading support 224 to support the wheel 218. As the bit 210 rotates in the bit direction of rotation 222, forces on the wheel 218 caused by contact with the formation may cause the wheel 218 to rotate. The wheel 218 may rotate about the wheel support 228. Because the wheel support 228 is supported on both the leading support 224 and the trailing support 226, the wheel support 228 may be able to support higher loads than if the wheel support were supported on only one of the leading support 224 or the trailing support 226. The wheel support 228 may include one or more bearings, seals, flanges, washers, and other elements used to structurally support the wheel 218 and facilitate rotation of the wheel.

During rotation of bit 210, the formation may cause the wheel 218 to be pushed laterally (e.g., opposite the bit direction of rotation 222) against the trailing support 226. In some embodiments, the wheel 218 may shift, vibrate, or otherwise be pushed toward the trailing support during operation. In some embodiments, the forces on the wheel 218 may open up a gap between the wheel and the leading support 224. In some embodiments, this gap may cause the seals to be ineffective on the wheel 218. In some embodiments, drilling fluid, cuttings, debris, other elements, and combinations thereof may infiltrate the seals and enter into portions of the wheel support 228. This may increase the wear on the wheel support 228 and/or the wheel, which may reduce the service life of the wheel 218.

In some embodiments, the deflection of the trailing support 226 may be caused by forces on the elements of the wheel support structure 215 (e.g., the wheel cutting elements 220 and/or the wheel 218) coming into contact with the formation. These forces may be transferred through the wheel 218 to the trailing support 226. In some embodiments, these forces may cause the compression of the components (e.g., seals) of the wheel support structure 215 and/or the deflection of the trailing support 226. This may cause the wheel 218 to separate from the leading support 224.

In some embodiments, to ensure a tight fit at installation between the wheel 218 and the leading support, one or more shim 232 may be installed between the wheel 218 and the leading support 224. The one or more shims 232 may fill in any gaps between the wheel 218 and the leading support 224 at installation when the wheel 218 is pressed against the trailing support 226. In this manner, the shims 232 may help to reduce a gap between the wheel 218 and the leading support 224 by providing an initial tight fit. This may help to reduce and/or prevent infiltration of drilling fluid and other debris into gaps between any of the leading support 224 and the leading flange of the wheel support 228, the wheel 218 and the leading flange of the wheel support 228, the wheel 218 and the trailing flange of the wheel support 228, or the trailing flange of the wheel support 228 and the trailing support 226.

In some embodiments, to close and/or prevent the gap from forming between the wheel 218 and the leading support 224, a saddle 234 between the trailing support 226 and the primary fixed blade 214-1 may have a depth along an axis of the bit of less than 0.5 in. below a fixed blade cutting element 216 (e.g., innermost cutting fixed blade element 216 of the primary fixed blade 214-1). The trailing support 226 may be connected to the body 212 of the bit 210 at a base of the trailing support 226, such as proximate the nozzle at the leading face of the primary fixed blade 214-1. This may resemble a cantilevered support. By reducing the height along an axis of the bit of at least a portion of the trailing support 226 near a gauge of the bit, the length of the trailing support 226 that extends above the saddle 234 near the axis of the bit may be reduced. This may increase the strength of the trailing support 226 and reduce the amount of deflection experienced by the trailing support 226. Reducing the deflection of the trailing support 226 may reduce the size of the gap or separation of the wheel 218 from the leading support 224, thereby reducing the chance of infiltration of drilling fluid or other debris into the wheel 218 and/or structures of the wheel support 228.

The bit 210 may include a central nozzle 237. In some embodiments, the central nozzle 237 may be located in an interior portion of the wheel slot 238. In some embodiments, the central nozzle 237 may be located at the rotational axis of the bit 210 (e.g., the central nozzle 237 may be centered on the rotational axis of the bit 210). In some embodiments, the orientation of the wheels 218 about the bit rotational axis 239 may allow the conical shaped wheel cutting elements 220 to cut the formation at the center of the wellbore.

In some embodiments, the wheels 218 on the wheel support structure 215 may be installed in wheel slots 238 formed between the trailing support 226 and the leading support 224. In some embodiments, the wheel slots on opposing wheel support structure 215 may be at least partially continuous across the bit 210. In other words, there may be linear paths across the bit 210 with no bit material between opposing wheel support structures at the wheel slots 238.

The bit 210 has a bit diameter. In some embodiments, the bit diameter may be in a range having an upper value, a lower value, or upper and lower values including any of 6 in. (15.2 cm), 7 in. (17.8 cm), 8 in. (20.3 cm), 9 in. (22.9 cm), 10 in. (25.4 cm), 12 in. (30.5 cm), 14 in. (35.6 cm), 16 in. (40.6 cm), 18 in. (45.7 cm), 20 in. (50.8 cm), 25 in. (63.5 cm), 30 in. (76.2 cm), or any value therebetween. For example, the bit diameter may be greater than 6 in. (15.2 cm). In another example, the bit diameter may be less than 30 in. (76.2 cm). In yet other examples, the bit diameter may be any value in a range between 6 in. (15.2 cm) and 30 in. (76.2 cm).

In some embodiments, a wheel diameter may be in a range having an upper value, a lower value, or upper and lower values including any of 2.0 in. (5.08 cm), 2.5 in. (6.35 cm), 3.0 in. (7.62 cm), 3.5 in. (8.89 cm), 4.0 in. (10.16 cm), 4.5 in. (11.43 cm), 5.0 in. (12.70 cm), 5.5 in. (13.97 cm), 6.0 in. (15.24 cm), 7.0 in. (17.78 cm), 8.0 in. (20.32 cm), 9.0 in. (22.86 cm), 10.0 in. (25.40 cm), 12 in. (30.48 cm), 14 in. (35.56 cm), 16 in. (40.64 cm), 18 in. (45.72 cm), 20 in. (50.80 cm), 21 in. (53.34 cm), 22 in. (55.88 cm), 24 in. (60.96 cm) 25 in. (63.50 cm), or any value therebetween. In some embodiments, a wheel diameter may be a wheel percentage of the bit diameter. In some embodiments, the wheel percentage for the wheel diameter may be in a range having an upper value, a lower value, or upper and lower values including any of 10%, 15%, 20%, 25%, 30%, 35%, 40%, 45%, 50%, 55%, 60%, 65%, 70%, 75%, or any value therebetween. For example, the diameter percentage may be greater than 10%. In another example, the diameter percentage may be less than 75%. In yet other examples, the diameter percentage may be any value in a range between 10% and 75%. In some embodiments, it may be critical that the diameter percentage is at least 50% to provide for a greater percentage of cutting of the formation by the cutting elements of the wheel.

Figures 2, 3:
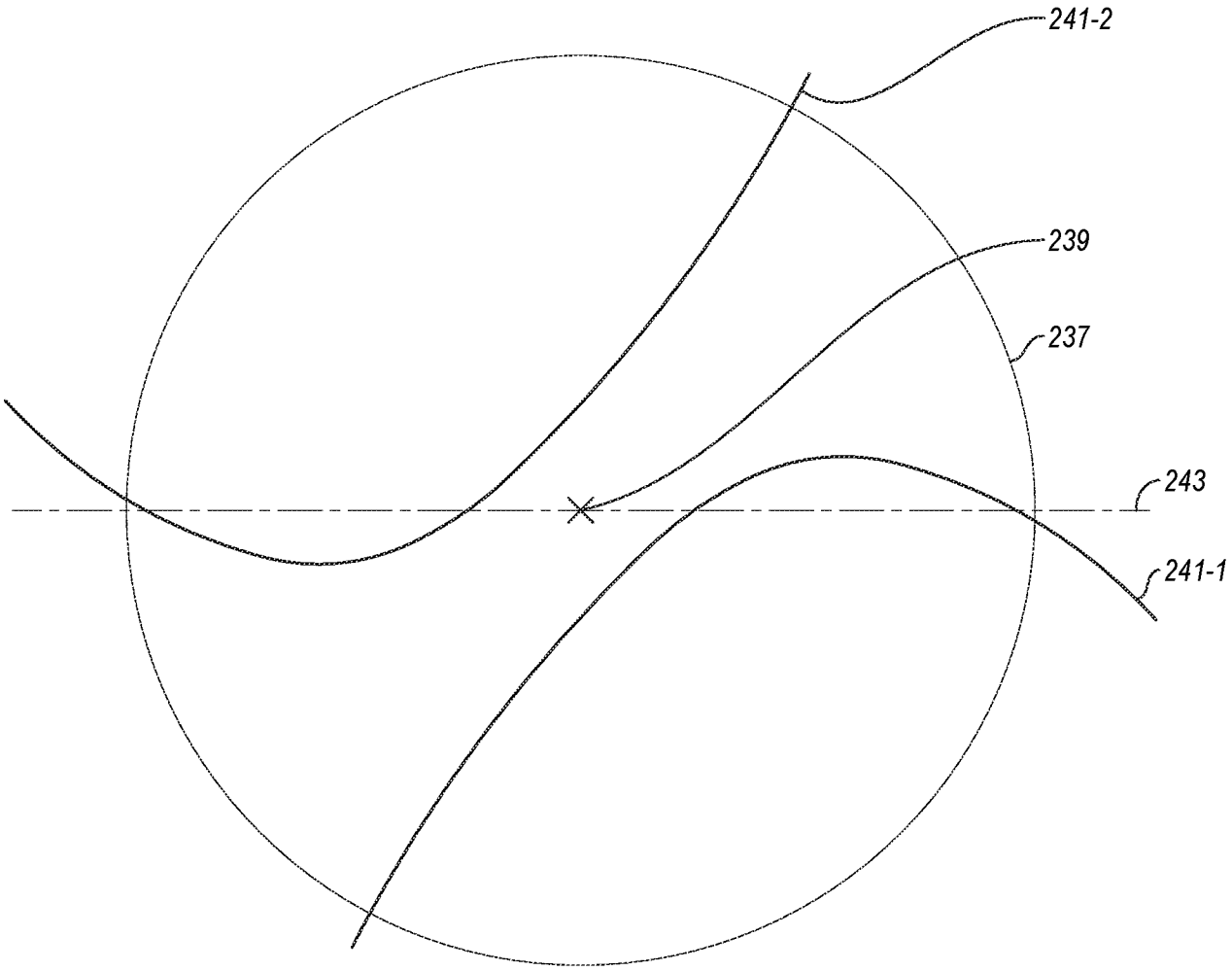

FIG. 2-3 is a representation of a close-up portion of the center of the bit 210 of FIG. 2-2. A first wheel cutting path 241-1 and a second wheel cutting path 241-2 are shown overlaid over the central nozzle 237. As may be seen, the first wheel cutting path 241-1 and the second wheel cutting path 241-2 cross a plane 243 that extends through the bit rotational axis 239. In some embodiments, the first wheel cutting path 241-1 and the second wheel cutting path 241-2 may cross a plane 243 which bisects the wheel rotational axes of the wheels 218. Thus, as the bit rotates, the cutting elements that cut the first wheel cutting path 241-1 and the second wheel cutting path 241-2 may cut the portion of the formation at or closer to the bit rotational axis 239 than if the first wheel cutting path 241-1 and the second wheel cutting path 241-2 did not cross the plane 243.

Figures 2, 3, 4:
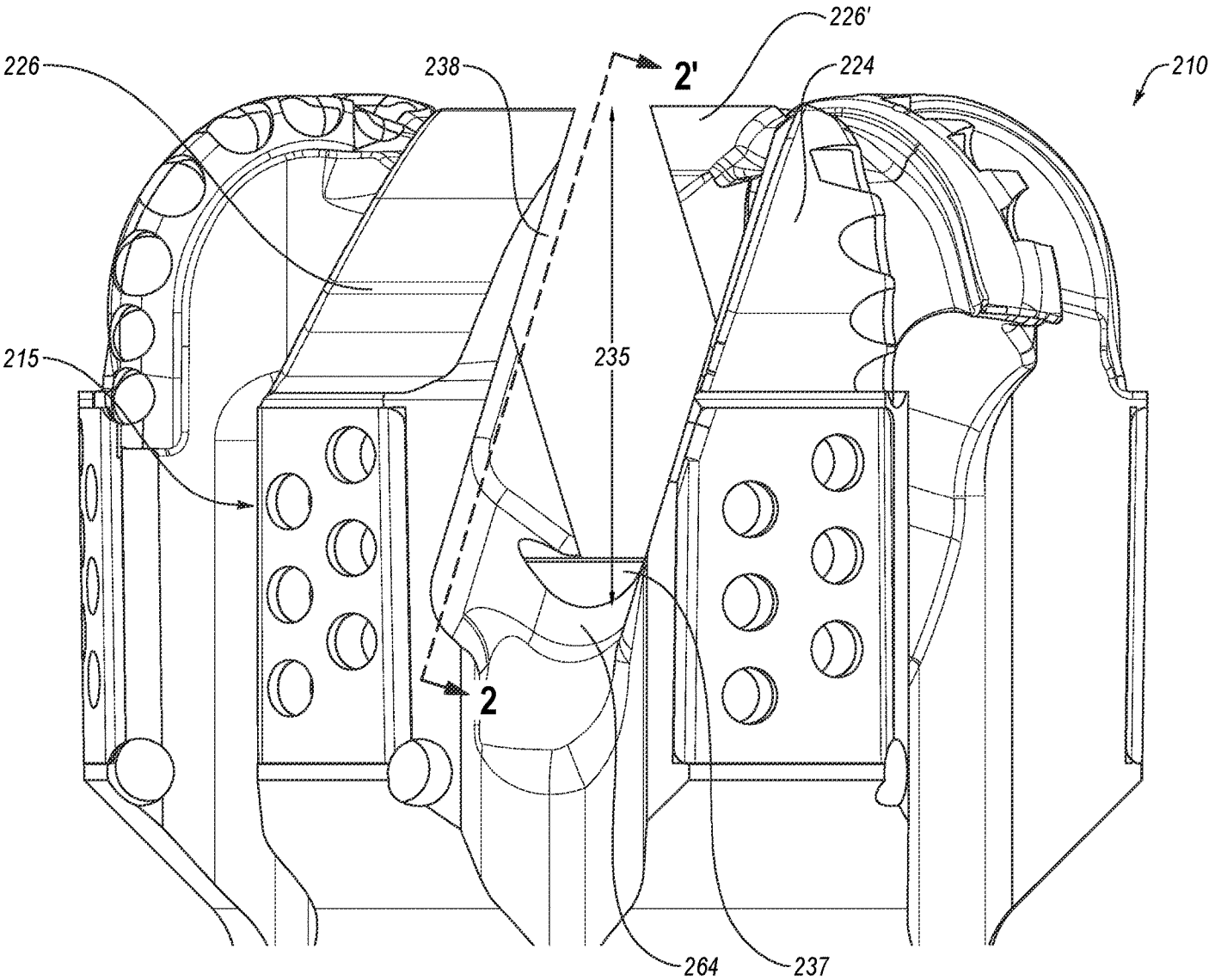
Figure 3:
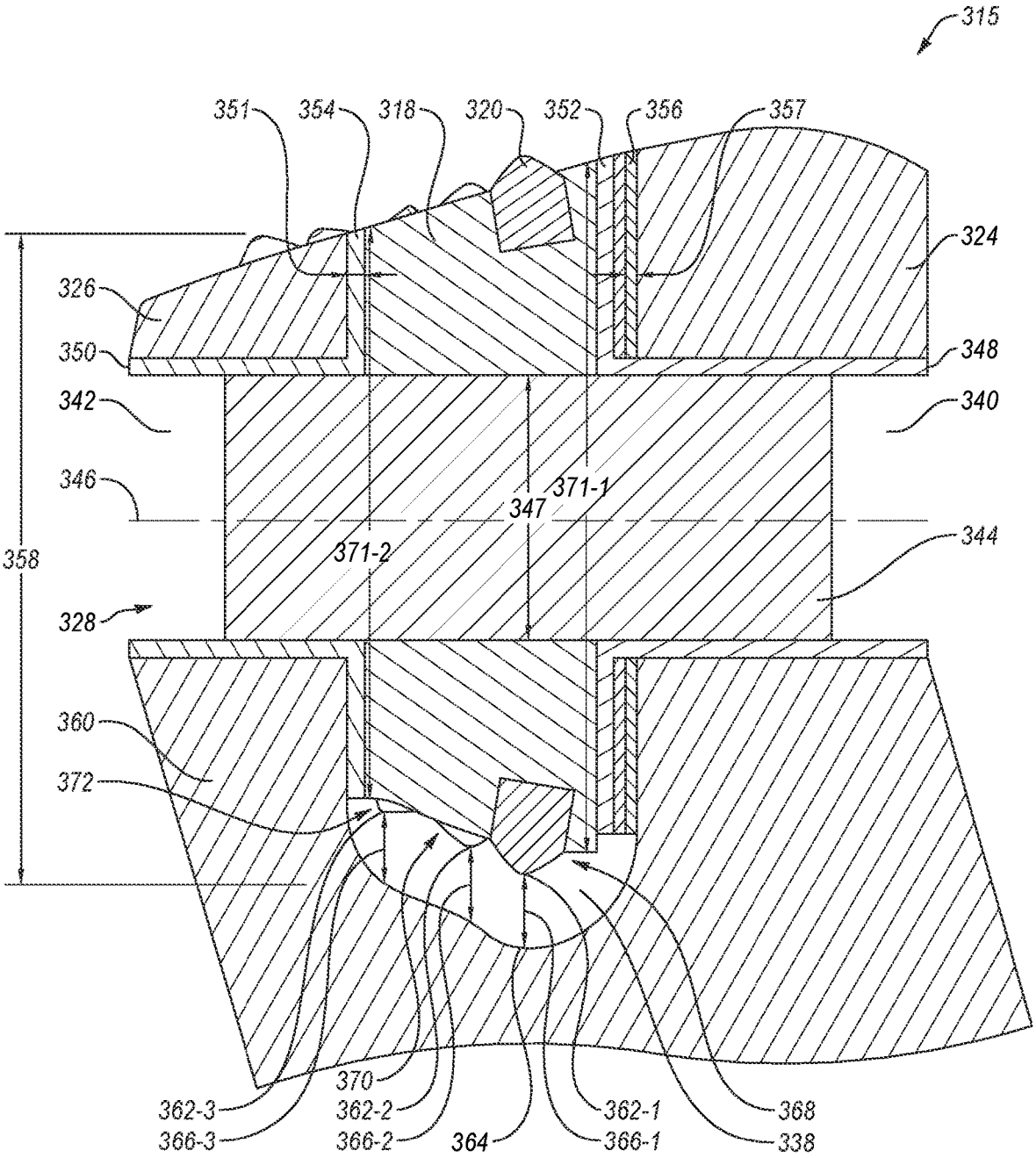
Figure 4:
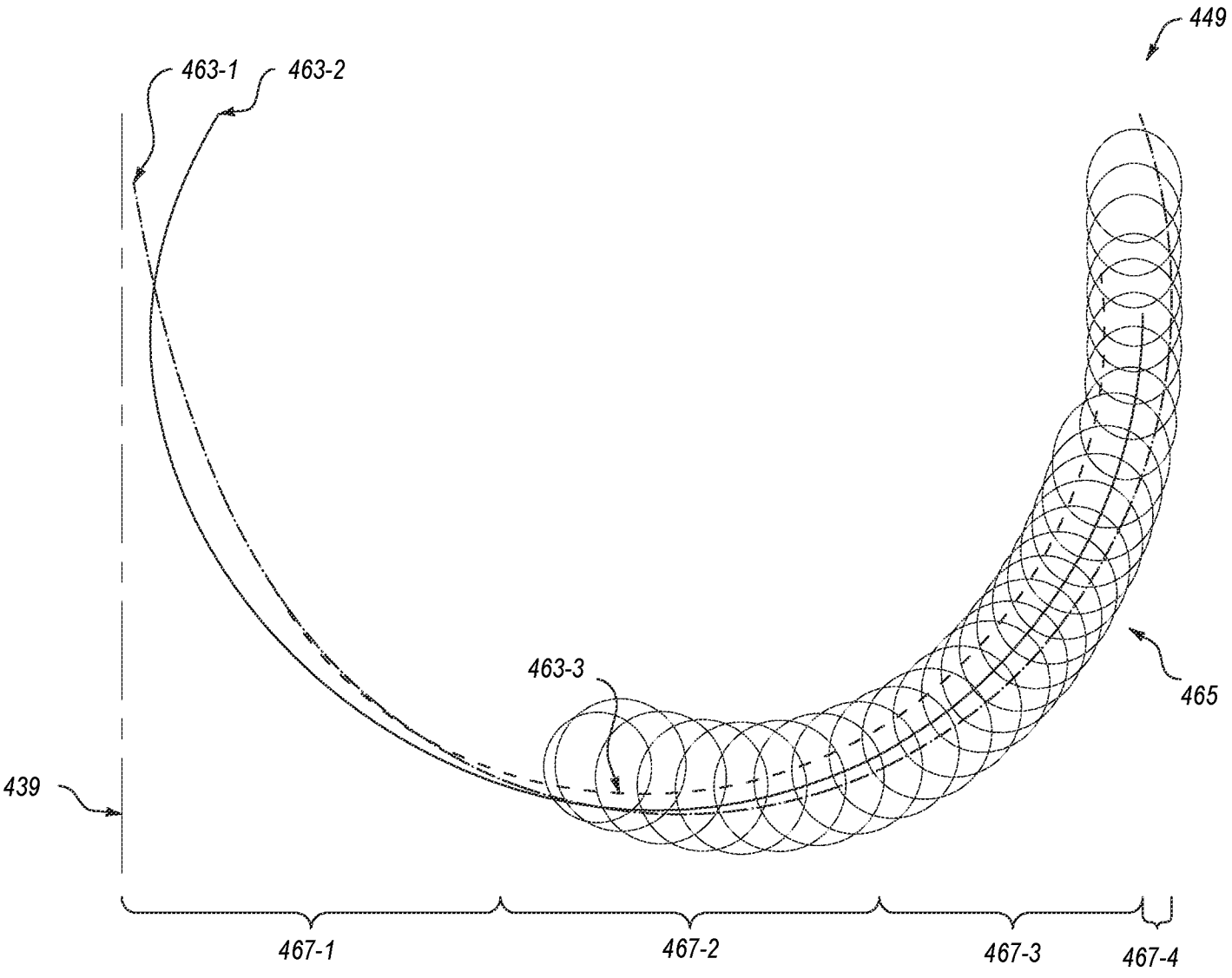

FIG. 2-4 is a representation of a side-view of the bit 210 with the wheels (e.g., the wheels 218 of FIG. 2-1) removed from the wheel support structure 215. A leading support 224 and a trailing support 226 form a wheel slot 238 between them, into which a wheel is inserted. The wheel slot 238 has a wheel slot depth 235. The wheel slot depth 235 may be the distance along the bit axis from the top-most edge (e.g., the bottomhole most edge when drilling) of the leading support 224 to a slot base 264. In some embodiments, the wheel slot depth 235 may be the distance from a tip of a bottommost cutting element on a fixed blade 214 to the slot base 264. In some embodiments, the wheel slot depth 235 may be equal to (e.g., the same as) or greater than a wheel diameter of the wheel. In some embodiments, the wheel slot depth 235 at the central nozzle 237 may be the equal to or greater than the wheel diameter. In some embodiments, the central nozzle 237 may extend up past the slot base 264, such that the wheel slot depth 235 at the central nozzle 237 is less than the wheel slot depth 235 at a radial distance from the central nozzle 237. This placement of the central nozzle 237 within the wheel slot 238 may facilitate cuttings removal and mitigate packing within the wheel slot 238.

In some embodiments, the wheel slot 238 may extend all the way through a radial diameter of the bit 210. For example, in the view shown, the central nozzle 237 is visible through the wheel slot 238, and the slot base 264 extends up to the central nozzle 237. In some embodiments, the wheel slot 238 of any wheel support structure 215 on the bit 210 may have a slot base 264 that extends up to the central nozzle, and the wheel slot depth 235 may be the same as or greater than the wheel diameter at the central nozzle 237 for each wheel support structure 215 on the bit 210.

In some embodiments, a wheel slot 238 in a wheel support structure opposing the wheel support structure 215 shown is visible through the wheel slot 238. The trailing support 226' from the opposing wheel slot 238 is shown in FIG. 2-4. Both wheel slots 238 may extend to the central nozzle 237. Thus, in some embodiments, at least a portion of opposing slots may intersect at the central nozzle 237. This may allow a single central nozzle 237 to flush cuttings for two or more wheels on opposing wheel support structure 215.

In some embodiments, as may be seen in FIG. 2-4, the wheel slots 238 may intersect. In other words, a curve, such as a planar curve (e.g., a line), an arcuate curve (e.g., a non-straight line) may be drawn through both wheel slots 238 that may not encounter any bit material. In some embodiments, the line may be drawn at an upper surface of the central nozzle 237. In some embodiments, the line may be perpendicular to the bit rotational axis.

FIG. 3 is a representation of a schematic view of a cross-section of a wheel support structure 315 taken along line 1-1' in FIG. 2-2, according to at least one embodiment of the present disclosure. The wheel support structure 315 includes a leading support 324 and a trailing support 326. The leading support 324 may be located rotationally ahead (e.g., leading) the trailing support 326. A wheel slot 338 is formed between the leading support 324 and the trailing support 326. The wheel 318 is inserted into the wheel slot 338. The leading support 324 includes a leading journal bore 340 extending therethrough and the trailing support 326 includes a trailing journal bore 342 extending therethrough. A wheel support 328 assembly may support the wheel 318 in the wheel slot 338. The leading journal bore 340 and the trailing journal bore 342 may be aligned. In other words, the leading journal bore 340 and the trailing journal bore 342 may have a common axis, or may be aligned such that the journal shaft 344 may be inserted through the leading journal bore 340 and into the trailing journal bore 342. In some embodiments, the leading journal bore 340 and the trailing journal bore 342 may be coaxial with the wheel axis of rotation 346. In some embodiments, one or both of the leading journal bore 340 and the trailing journal bore 342 may have asymmetric features relative to the wheel axis of rotation 346 that reduce or eliminate rotation of flanges and covers within the journal bores while permitting the wheel 318 to rotate about the axis 346.

The wheel support 328 may include a journal shaft 344 that extends through the leading journal bore 340 and a trailing journal bore 342. The wheel 318 may rotate about the journal shaft 344 around a wheel axis of rotation 346. In some embodiments, rotation of the wheel 318 may be supported by a bearing or a bushing, such as a journal bearing. In accordance with embodiments of the present disclosure, the journal shaft 344 may be secured to the wheel support structure 315 in any manner, such as with a bolt, a threaded connection, a locking connection, braze, weld, any other connection mechanism, and combinations thereof.

The journal shaft 344 has a journal diameter 347. In some embodiments, the journal diameter 347 may be in a range having an upper value, a lower value, or upper and lower values including any of 1 in. (2.54 cm), 1.1 in. (2.78 cm), 1.2 in. (3.05 cm), 1.3 in. (3.30 cm), 1.4 in. (3.56 cm), 1.5 in. (3.81 cm), 1.6 in. (4.06 cm), 1.7 in. (4.32 cm), 1.8 in. (4.58 cm), 1.9 in. (4.83 cm), 2.0 in. (5.08 cm), or any value therebetween. For example, the journal diameter 347 may be greater than 1.0 in. (2.54 cm). In another example, the journal diameter 347 may be less than 2.0 in. (5.08 cm). In yet other examples, the journal diameter 347 may be any value in a range between 1.0 in. (2.54 cm) and 2.0 in. (5.08 cm). In some embodiments, it may be critical that the journal diameter 347 is greater than 1.0 in. (2.54 cm) to increase the strength of the journal shaft 344.

In some embodiments, the journal diameter 347 may be a journal percentage of the bit diameter (e.g., journal diameter 347 divided by bit diameter multiplied by 100). In some embodiments, the journal percentage may be in a range having an upper value, a lower value, or upper and lower values including any of 8%, 9%, 10%, 11%, 12%, 13%, 14%, 15%, 16%, 17%, 18%, 19%, 20%, or any value therebetween. For example, the journal percentage may be greater than 8%. In another example, the journal percentage may be less than 20%. In yet other examples, the journal percentage may be any value in a range between 8% and 20%. In some embodiments, it may be critical that the journal percentage is at least 8% to provide a journal shaft 344 that is sufficiently strong to support the forces encountered during downhole drilling. In some embodiments, it may be critical that the journal percentage is at least 12% to provide a journal shaft 344 that is sufficiently strong to support the forces encountered during downhole drilling. In some embodiments, it may be critical that the journal percentage is at least 16% to provide a journal shaft 344 that is sufficiently strong to support the forces encountered during downhole drilling. For example, a bit having a bit diameter of 8.5 in. (21.6 cm) may have a journal diameter 347 of 1.5 in. (3.81 cm), which is a journal percentage of 17.6%. A bit having a bit diameter of 16 in. (40.6 cm) may have a journal diameter 347 of 2 in. (5.08 cm), which is a journal percentage of 12.5%. A bit having a bit diameter of 28 in. (72.1 cm) may have a journal diameter 347 of 2.5 in. (6.35 cm), which is a journal percentage of 8.9%.

The wheel support 328 may further include a leading support flange 348 and a trailing support flange 350. The leading support flange 348 and the trailing support flange 350 may support the journal shaft 344 and/or the journal bearing about which the wheel 318 rotates. In some embodiments, one or both of the leading support flange 348 and the trailing support flange 350 may have asymmetric features relative to the wheel axis of rotation 346. For example, a surface of the leading support flange 348 adjacent the journal shaft 344 may have a greater depth along the bit axis near the interior of the bit than near the nose of the bit. The leading support flange 348 may include a leading support bearing plate 352 and the trailing support flange 350 may include a trailing support bearing plate 354. The leading support bearing plate 352 and the trailing support bearing plate 354 may provide a sealing surface for any seals or gaskets on the wheel 318 and may provide a bearing surface against which the wheel 318 may contact during rotation. In some embodiments, one or more of the leading support flange 348 and the trailing support flange 350 has a nitrided sealing surface for strength, wear resistance, and seal quality. In some embodiments, a washer may be arranged between the wheel 318 and the leading support flange 348 and/or the trailing support flange 350 to reduce wear of the flanges and wheel 318. The washer may engage with the wheel 318 along a radial washer distance between 5 and 30% of the wheel radius. In some embodiments, one or both of the leading support flange 348 and the trailing support flange 350 may be hardened, such as by case hardening. In some embodiments, one or both of the leading support flange 348 and the trailing support flange 350 may be harder and/or have a higher strength than the leading support 324 or the trailing support 326.

In some embodiments, the leading support flange 348 and/or the trailing support flange 350 include a support flange thickness 351. In some embodiments, the support flange thickness 351 may be in a range having an upper value, a lower value, or upper and lower values including any of 0.010 in. (0.254 mm), 0.02 in. (0.508 mm), 0.03 in. (0.762 mm), 0.040 in. (1.02 mm), 0.050 in. (1.27 mm), 0.060 in. (1.52 mm), 0.07 in. (1.78 mm), 0.080 in. (2.03 mm), 0.090 in. (2.29 mm), 0.100 in. (2.54 mm), 0.200 in. (5.08 mm), 0.300 in. (7.62 mm), 0.400 in. (10.16 mm), 0.500 in. (12.7 mm), 1.00 in. (25.4 mm), or any value therebetween. For example, the support flange thickness 351 may be greater than 0.010 in. (0.254 mm). In another example, the support flange thickness 351 may be less than 1.00 in. (25.4 mm). In yet other examples, the support flange thickness 351 may be any value in a range between 0.010 in. (0.254 mm) and 1.00 in. (25.4 mm). In some embodiments, it may be critical that the support flange thickness 351 is between 0.080 in. (2.03 mm) and 0.200 in. (5.08 mm) to provide a strong bearing surface while providing room for other elements in the wheel support structure 315. In some embodiments, it may be critical that the support flange thickness 351 is approximately 0.100 in. (2.54 mm) to provide a balance between bearing surface strength and room for elements of the wheel support structure 315.

In some embodiments, the leading support flange 348 has the same thickness as the trailing support flange 350. In some embodiments, the leading support flange 348 may have a larger thickness than the trailing support flange 350. In some embodiments, the leading support flange 348 may have a smaller thickness than the trailing support flange 350. Increasing the thickness of the trailing support flange 350 may mitigate the formation of gaps in the wheel support structure 315 more than increasing the thickness of the leading support flange 348.

The leading support flange 348 and the trailing support flange 350 are configured to support the journal shaft 344 along at least a portion of a journal length of the journal shaft 344. In some embodiments, the leading support flange 348 and the trailing support flange 350 each support at least 0.050 in. (1.27 mm) of the journal shaft 344. The leading support flange 348 and the trailing support flange 350 may each support more than 5 to 40% of the journal length. In some embodiments, the leading support flange 348 may support more of the journal length than the trailing support flange 350. Chamfered or beveled edges of the leading support flange 348 and trailing support flange 350 may reduce the length of interface with the journal shaft 344

Forces encountered during drilling activities may push the wheel 318 toward the trailing support 326. This may cause the wheel 318 to move away from the leading support 324. In some embodiments, this may cause the wheel 318 to separate from the leading support 324 and/or the leading support flange 348, causing a gap through which drilling fluid and/or other debris may enter.

To close any gaps that may exist during assembly, and thereby reduce and/or prevent the separation of the wheel 318 from the leading support 324 and/or the leading support flange 348, one or more shims 356 may be installed between the wheel 318 and the leading support flange 348. This may fill in the initial gap, thereby reducing and/or eliminating drilling fluid and/or debris infiltration into the wheel support 328. This may increase the operational lifetime of the wheel 318, thereby reducing costs. Increasing the operational lifetime of the wheel 318 may enable the wheel 318 to be utilized in multiple wells and/or with multiple bit assemblies.

In some embodiments, the shims 356 may be installed between the leading support bearing plate 352 and the leading support 324. In some embodiments, the shims 356 may be installed between the wheel 318 and the leading support bearing plate 352. In some embodiments, a shim 356 may be installed between the wheel 318 and the leading support bearing plate 352 and another shim 356 may be installed between the leading support bearing plate 352 and the leading support 324.

In some embodiments, the shims 356 may have a shim width 357. In some embodiments, the shim width 357 may be in a range having an upper value, a lower value, or upper and lower values including any of 0.001 in. (25.4 μm), 0.002 in. (50.8 μm), 0.003 in. (76.2 μm), 0.004 in. (102 μm), 0.005 in. (127 μm), 0.010 in. (254 μm), 0.015 in. (381 μm), 0.020 in. (508 μm), 0.025 in. (635 μm), 0.030 in. (762 μm), 0.035 in. (889 μm), 0.040 in. (1.02 mm), 0.045 in. (1.14 mm), 0.050 in. (1.27 mm), or any value therebetween. For example, the shim width 357 may be greater than 0.0001 in. (25.4 μm). In another example, the shim width 357 may be less than 0.050 in. (1.27 mm). In yet other examples, the shim width 357 may be any value in a range between 0.001 in. (25.4 μm) and 0.050 in. (1.27 mm). In some embodiments, the shims 356 may have widths of between 0.001 in. (25.4 μm) and 0.030 in. (762 μm) in 0.001 in. (25.4 μm) increments.

In some embodiments, more than one shim 356 may be installed between the wheel 318 and the leading support 324. Manufacturing tolerances may result in different sized gaps between the wheel 318 and the leading support 324. Therefore, to account for differences in manufacturing tolerances, shims 356 of differing widths may be installed between the wheel 318 and the leading support 324. Furthermore, to maximize the reduction in the gap between the wheel 318 and the leading support 324, multiple shims 356 of differing widths may be installed. In some embodiments, the shims 356 may be installed between the wheel 318 and the trailing support 326. In some embodiments, the shims 356 may be installed between both the wheel 318 and the trailing support 326 and between the wheel 318 and the leading support 324.

The wheel slot 338 may be formed between the leading support 324 and the trailing support 326 by machining material from the wheel support structure 315. As discussed above, forces acting on the wheel 318 during drilling activities may cause the trailing support 326 to deflect in the trailing direction. The extent of the deflection may be dependent upon a height 358 of the trailing support 326. In some embodiments, the height 358 is a distance from the outermost surface of the trailing support 326 near the wheel 318 and a slot base 364 of the wheel slot 338. A taller trailing support 326 (e.g., a trailing support 326 having a larger height 358) may result in larger moment arm about a base 360 of the trailing support 326. By reducing the height 358, the moment about the base 360 may be reduced, which may reduce the deflection of the trailing support 326. Reducing the deflection of the trailing support 326 may reduce the separation of the wheel 318 and the leading support 324 during drilling activities, thereby reducing the amount of drilling fluid and/or debris that may enter the wheel support 328.

To reduce the height 358 of the trailing support 326, the depth of the wheel slot 338 may be reduced. The depth of the wheel slot 338 may be greater than the diameter of the wheel 318. The wheel 318 has a furthest extent at a tip (collectively 362), which is the point on the wheel 318 that is furthest from the wheel axis of rotation 346. A slot base 364 may be offset from the furthest extent with offset 366. In some embodiments, the offset 366 may be in a range having an upper value, a lower value, or upper and lower values including any of 0.1 in. (2.54 mm), 0.2 in. (5.08 mm), 0.3 in. (7.62 mm), 0.4 in. (10.2 mm), 0.5 in. (12.7 mm), 0.6 in. (15.2 mm), 0.7 in. (17.8 mm), 0.8 in. (20.3 mm), 0.9 in. (22.9 mm), 1.0 in. (25.4 mm), or any value therebetween. For example, the offset 366 may be greater than 0.1 in (2.54 mm). In another example, the offset 366 may be less than 1.0 in (25.4 mm). In yet other examples, the offset 366 may be any value in a range between 0.1 in (2.54 mm) and 1.0 in (25.4 mm). In some embodiments, it may be critical that the offset 366 is less than 0.5 in. (12.7 mm) to reduce the height 358 of the trailing support 326, reduce its deflection, and maintain a seal between the wheel 318 and the leading support 324. In some embodiments, it may be critical that the offset 366 is approximately 0.25 in. (6.4 mm) to reduce the height 358 of the trailing support 326, reduce its deflection, and maintain a seal between the wheel 318 and the leading support 324.

In some embodiments, the wheel 318 may include a first row 368 of cutting elements, a second row 370 of cutting elements, and a third row 372 of cutting elements. In some embodiments, each row of cutting elements has a tip distance, which may be the distance from the wheel axis of rotation 346 to the tip 362 of a cutting element. The wheel 318 may have a different diameter proximate the leading support 324 than proximate the trailing support 326. For example, a leading wheel diameter 371-1 may be greater than a trailing wheel diameter 371-2. The wheel diameter 371 affects the placement of the rows of cutting elements on the wheel and the corresponding cutting profiles, as discussed in detail below. In some embodiments, the first tip distance of the first row 368 may be greater than the second tip distance of the second row 370, and the second tip distance of the second row 370 may be greater than the third tip distance of the third row 372. In other words, the third tip distance of the third row 372 may be less than the second tip distance of the second row 370, and the second tip distance of the second row 370 may be less than the first tip distance of the first row 368. In some embodiments, based on the orientation (e.g., tilt) of the wheel 318 and/or the wheel cutting elements 320, the second tip distance may be greater than the first tip distance in one or more sections of the bit, and less than the first tip distance is another, different section of the bit.

In some embodiments, the wheel slot 338 may have a first offset 366-1 between the first tip 362-1 of the first row 368 and the slot base 364, a second offset 366-2 between the second tip 362-2 of the second row 370 and the slot base 364, and a third offset 366-3 between the third tip 362-3 of the third row 372 and the slot base 364. The offsets 366 may facilitate evacuation of the cuttings from the wheel slot 338. In some embodiments, the first offset 366-1 may be the same as the second offset 366-2 and the third offset 366-3. In some embodiments, the first offset 366-1 may be different from one or both of the second offset 366-2 and the third offset 366-3. Because the tip distances change between the first row 368, the second row 370, and the third row 372, a slot base profile of the slot base 364 of the wheel slot 338 may be variable. That is, the varying wheel diameter 371 may vary the tip distances relative to the wheel axis 346, and the slot base profile may vary accordingly. Maintaining the third offset 366-3 near the trailing wheel diameter 371-2 the same as the first offset 366-1 near the leading wheel diameter 371-1 may reduce the height of the trailing support 326, because the base 360 of the trailing support 326 is shored up.

In some embodiments, the slot base profile may be parallel to the wheel rotational axis. In some embodiments, the slot base profile may be transverse to the wheel rotational axis. In some embodiments, the slot base profile may match or approximately match an outer profile of the wheel 318. In some embodiments, to reduce stress concentrations, the profile of the slot base 364 may be arcuate near the flanges 350, 348 between the trailing support 326 and the leading support 324.

FIG. 4 is a representation of a cutting element profile 449 of the bit of FIG. 2-1 through FIG. 2-4 as rotated about a bit rotational axis 439, according to at least one embodiment of the present disclosure. The profile 449 includes a plurality of wheel cutting profiles (collectively 463) and a fixed blade cutting profiles 465. In the profile 449 shown, the cutting profile that is shown as furthest outside relative to the other lines may indicate that the cutting elements that make up the profile are the primary cutting elements.

The wheel cutting profiles 463 include a first wheel cutting profile 463-1, which may be representative of the cutting profile of the first row (e.g., first row 368 of cutting elements of FIG. 3) of cutting elements, a second wheel cutting profile 463-2, which may be representative of the cutting profile of the second row (e.g., second row 370 of cutting elements of FIG. 3) of cutting elements, and a third wheel cutting profile 463-3, which may be representative of the cutting profile of the third row (e.g., third row 372 of cutting elements of FIG. 3) of cutting elements.

As indicated by the cutting element profile 449, the wheel cutting elements may be the only cutting elements that cut in the cone region 467-1 (e.g., the region closest to the bit rotational axis 439). Furthermore, as may be seen, the second wheel cutting profile 463-2 may is further outward than the first wheel cutting profile 463-1. This indicates that the second row of cutting elements are the primary cutting elements in the cone region. This may be because of the orientation of the wheel (e.g., wheel 218 of FIG. 2) relative to the bit rotational axis 439 and/or the individual cutting elements of the second row of cutting elements relative to a rotational axis of the wheel. However, it should be understood that, in some embodiments and based on the orientations of the wheel and the cutting elements in the first and/or second row, the first wheel cutting profile 463-1 may extend further outward than the second wheel cutting profile 463-2 in the cone region 467-1.

In some embodiments, the fixed blade cutting elements represented in the fixed blade cutting profile 465 may be the primary cutting elements in the nose region 467-2, through the shoulder region 467-3, and into the gauge region 467-4. Fixed blade cutting elements may be able to withstand greater forces, especially forces parallel to the bit rotational axis 439. The nose region 467-2 may experience the highest forces on the bit, which may be supported by the fixed blade cutting elements shown in the fixed blade cutting profile 465. While the cutting profiles shown in FIG. 4 may be described with respect to primary cutting elements, it should be understood that, in some embodiments, each cutting element profile shown may experience forces from the formation and remove a portion of the formation.

Figure 5:
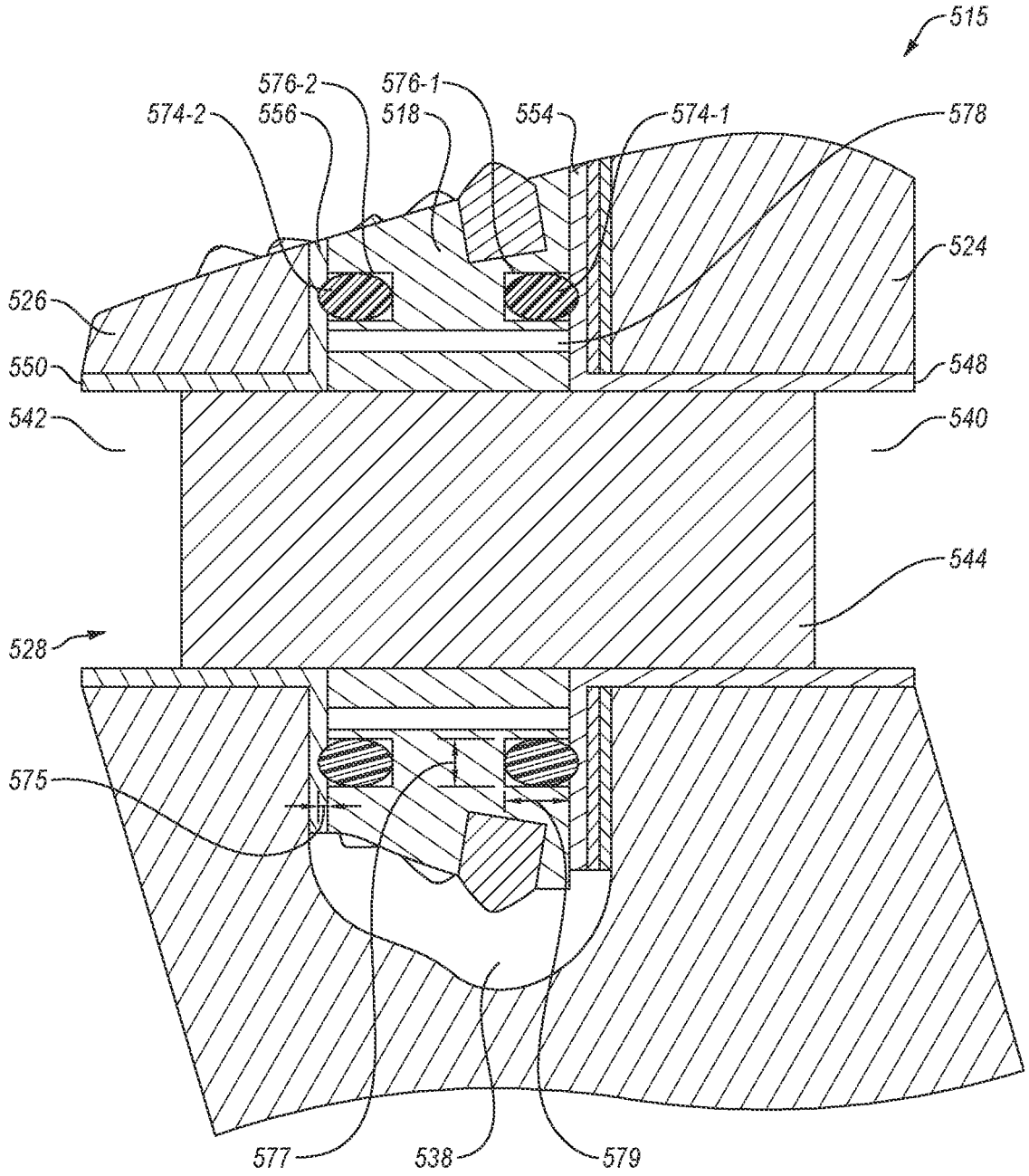
FIG. 5 is a representation of a cross-sectional view of another wheel support structure, according to at least one embodiment of the present disclosure.

FIG. 5 is a representation of a schematic cross-sectional view of a wheel support structure 515 taken along line 1-1' in FIG. 2-2, according to at least one embodiment of the present disclosure. In the embodiment shown, a wheel 518 is installed in a wheel slot 538 formed between a leading support 524 and a trailing support 526. A wheel support 528 supports the wheel 518. The wheel support 528 may include a leading support flange 548 installed in a leading journal bore 540 and a trailing support flange 550 installed in a trailing journal bore 542. The leading support flange 548 includes a leading support bearing plate 554 and the trailing support flange 550 includes a trailing support bearing plate 556. In some embodiments, the wheel 518 and the supports 524, 526 may be harder than the support flanges 548, 550.

To keep drilling fluid and/or other debris out of the wheel support 528, a seal (collectively 574) may be installed in a gland (collectively 576), such as a slot, a race, a groove, or other slot, in the wheel. The gland 576 may extend around the wheel 518 in a circle. The seal 574 may be a rubber, plastic, silicone, or other seal that pushes against the gland 576 and the bearing plates of the support flanges. As the wheel 518 rotates, the seal 574 may maintain a seal to keep drilling fluid and other debris out of the wheel support 528 and associated components.

The wheel support structure 515 may include a seal 574 on both sides of the wheel 518. In other words, a leading seal 574-1 may be installed in a leading slot 576-1 on a leading side of the wheel 518. The leading seal 574-1 may provide a seal by contacting the leading slot 576-1 and the leading support bearing plate 554. A trailing seal 574-2 may be installed in a trailing slot 576-2 on a trailing side of the wheel 518-1. The trailing seal 574-2 may provide a seal by contacting the trailing slot 576-2 and the trailing support bearing plate 554-2.

In some embodiments, the one or more seals 574 may be an O-ring. In some embodiments, the seal 574 may be elongated (e.g., with the longitudinal dimension being larger than the radial direction). In some embodiments, the seal 574 may be a bullet seal. In some embodiments, the leading seal 574-1 may be an elongated seal and the trailing seal 574-2 may be an O-ring. In some embodiments, the leading seal 574-1 may be an O-ring and the trailing seal 574-2 may be an elongated seal. In some embodiments, both the leading seal 574-1 and the trailing seal 574-2 may be elongated seals. In some embodiments, both the leading seal 574-1 and the trailing seal 574-2 may be O-rings. In some embodiments, the leading seal 574-1 and/or the trailing seal 574-2 may be a mechanical seal.

The seal 574 has an exposure 575, which may be the distance that the seal 574 extends past the wheel 518 when installed in the gland 576. In some embodiments, the exposure 575 may at least partially contribute to the strength of the seal created by the seal 574. For example, a higher exposure 575 may result in a stronger seal. In some embodiments, the higher exposure 575 may increase the strength of the seal because the seal 574 may compress more and provide a greater sealing force against the support bearing plate.

In some embodiments, the exposure 575 may be in a range having an upper value, a lower value, or upper and lower values including any of 0.025 in. (0.635 mm), 0.030 in. (0.762 mm), 0.040 in. (1.02 mm), 0.050 in. (1.27 mm), 0.060 in. (1.52 mm), 0.070 in. (1.78 mm), 0.080 in. (2.03 mm), 0.090 in. (2.29 mm), 0.100 in. (2.54 mm), or any value therebetween. For example, the exposure 575 may be greater than 0.025 in. (0.635 mm). In another example, the exposure 575 may be less than 0.100 in. (2.54 mm). In yet other examples, the exposure 575 may be any value in a range between 0.025 in. (0.635 mm) and 0.100 in. (2.54 mm). In some embodiments, it may be critical that the exposure 575 is greater than 0.025 in. (0.635 mm) to provide a seal and allow for a little lateral movement by the wheel 518. In some embodiments, the exposure 575 may be greater than 0.030 in. (0.762 in.). In some embodiments, the exposure may be between 0.035 in. (0.889 mm) and 0.100 in. (2.54 mm). In some embodiments, the exposure may be between 0.050 in. (1.27 mm) and 0.080 in. (2.03 mm). In some embodiments, the exposure may be between 0.055 in. (1.40 mm) and 0.070 in. (1.78 mm).

The seal 574 has a seal height 579 in the longitudinal direction and a seal width 577 in the radial direction. In some embodiments, the exposure 575 and the seal height 579 have an exposure to seal height ratio (e.g., exposure:seal height). The exposure to seal height ratio may indicate the strength of the seal provided by the seal 574. A higher exposure to seal height ratio (e.g., an exposure to seal height ratio of 1:7 indicates that the seal height 579 is 7 times greater than the exposure 575) may indicate a higher strength seal. In some embodiments, the exposure to seal height ratio may be in a range having an upper value, a lower value, or upper and lower values including any of 1:7, 1:6.5, 1:6, 1:5.5, 1:5, 1:4.5, 1:4, or any value therebetween. For example, the exposure to seal height ratio may be less than 1:4. In another example, the exposure to seal height ratio may be greater than 1:7. In yet other examples, the exposure to seal height ratio may be any value in a range between 1:4 and 1:7. In some embodiments, it may be critical that the exposure to seal height ratio is greater than 1:7 to provide a strong seal. In some embodiments, it may be critical that the exposure to seal height ratio is greater than 1:6 to provide a strong seal. In some embodiments, it may be critical that the exposure to seal height ratio is greater than 1:5 to provide a strong seal. In some embodiments, the compression of the seal 574 (e.g., the squeeze of the seal 574) may impact the strength and/or workability of the seal. A longer seal (e.g., a seal 574 having a lower exposure to seal height ratio) may be able to experience a greater compression at a lower force.

In some embodiments, the seal width 577 and the seal height 579 have a seal width to height percentage (e.g., seal width 577 divided by seal height 579 multiplied by 100). In some embodiments, the seal width to height percentage may provide an indication of the strength of the seal by the seal 574. In some embodiments, the width to height percentage may be in a range having an upper value, a lower value, or upper and lower values including any of 30%, 35%, 40%, 45%, 50%, 55%, 60%, 65%, 70%, 75%, 80%, 85%, 90%, 95%, 100%, or any value therebetween. For example, the width to height percentage may be greater than 30%. In another example, the width to height percentage may be less than 100%. In yet other examples, the width to height percentage may be any value in a range between 30% and 100%. In some embodiments, it may be critical that the width to height percentage is between 40% and 70% to improve the strength of the seal. In some embodiments, it may be critical that the width to height percentage is between 45% and 60% to improve the strength of the seal. In some embodiments, the compression of the seal 574 (e.g., the squeeze of the seal 574) may impact the strength and/or workability of the seal. A longer seal (e.g., a seal 574 having a lower width to height percentage) may be able to experience a greater compression at a lower force. However, a shorter seal (e.g., having a higher width to height percentage) may be more wear resistant.

The seal 574 has a durometer, or hardness. In some embodiments, the durometer may be in a range having an upper value, a lower value, or upper and lower values including any of 50, 55, 60, 65, 70, 75, 80, 85, 90, 95, or any value therebetween. For example, the durometer may be greater than 50. In another example, the durometer may be less than 95. In yet other examples, the durometer may be any value in a range between 50 and 95. In some embodiments, it may be critical that the durometer is between 50 and 90 to balance compliance of the seal 574 with sealing properties of the seal. In some embodiments, it may be critical that the durometer is between 55 and 85, between 60 and 80, between 70 and 95, between 75 and 90, or between 80 and 85.

In some embodiments, the seal 574 may have a durometer that changes. For example, the durometer may change along its height 579. In some embodiments, the durometer of the seal 574 may be lower (e.g., softer) in the gland 576. In some embodiments, the durometer of the seal 574 may be harder where the seal 574 contacts its opposing sealing component (the bearing plates in the embodiment shown). In some embodiments, a majority (e.g., more than 50%) of the seal 574 may be softer (e.g., having a durometer between 55 and 85 or between 60 and 80). In some embodiments, a minority (e.g., less than 50%) of the height 579 of the seal 574 may be harder (e.g., having a durometer between 70 and 95, between 75 and 90, or between 80 and 85).

In some embodiments, the wheel support 528 may include further elements, including a radial bearing surface (such as the leading support bearing plate 554 and the trailing support bearing plate 556). In some embodiments, the wheel support may include a thrust washer to maintain pressure on components in the wheel support 528. In some embodiments, the wheel support 528 may include a journal bearing or other bearing sleeve between the wheel 518 and the journal shaft 544. In some embodiments, the journal bearing or bearing sleeve may have a larger diameter than an outer diameter of the journal shaft 544 and a smaller diameter than an inner diameter of the bore through the wheel 518.

In some embodiments, one or more bearings, bushings, seals, or other elements in the wheel support 528 may utilize a lubricant, such as grease or oil. In some embodiments, to facilitate the flow of lubricant within the wheel support 528, the wheel 518 may include a lubricant port 578. The one or more lubricant ports 578 may be arranged radially between the journal shaft 544 and the seals 574. The lubricant port 578 may allow lubricant to flow from the trailing side of the wheel 518 to the leading side of the wheel 518 and vice versa. This may improve the rotation of the wheel 518, thereby improving the efficiency of the drilling system.

In some embodiments, the lubricant ports 578 may allow for pressure balance on the leading side and the trailing side of the wheel 518. In some embodiments, the lubricant ports 578 may provide a lower-resistance path (compared to traveling along a journal bearing or sleeve) for lubricant to travel between the leading side and the trailing side of the wheel 518. This may help to improve the rotation of the wheel 518.

Figure 6:
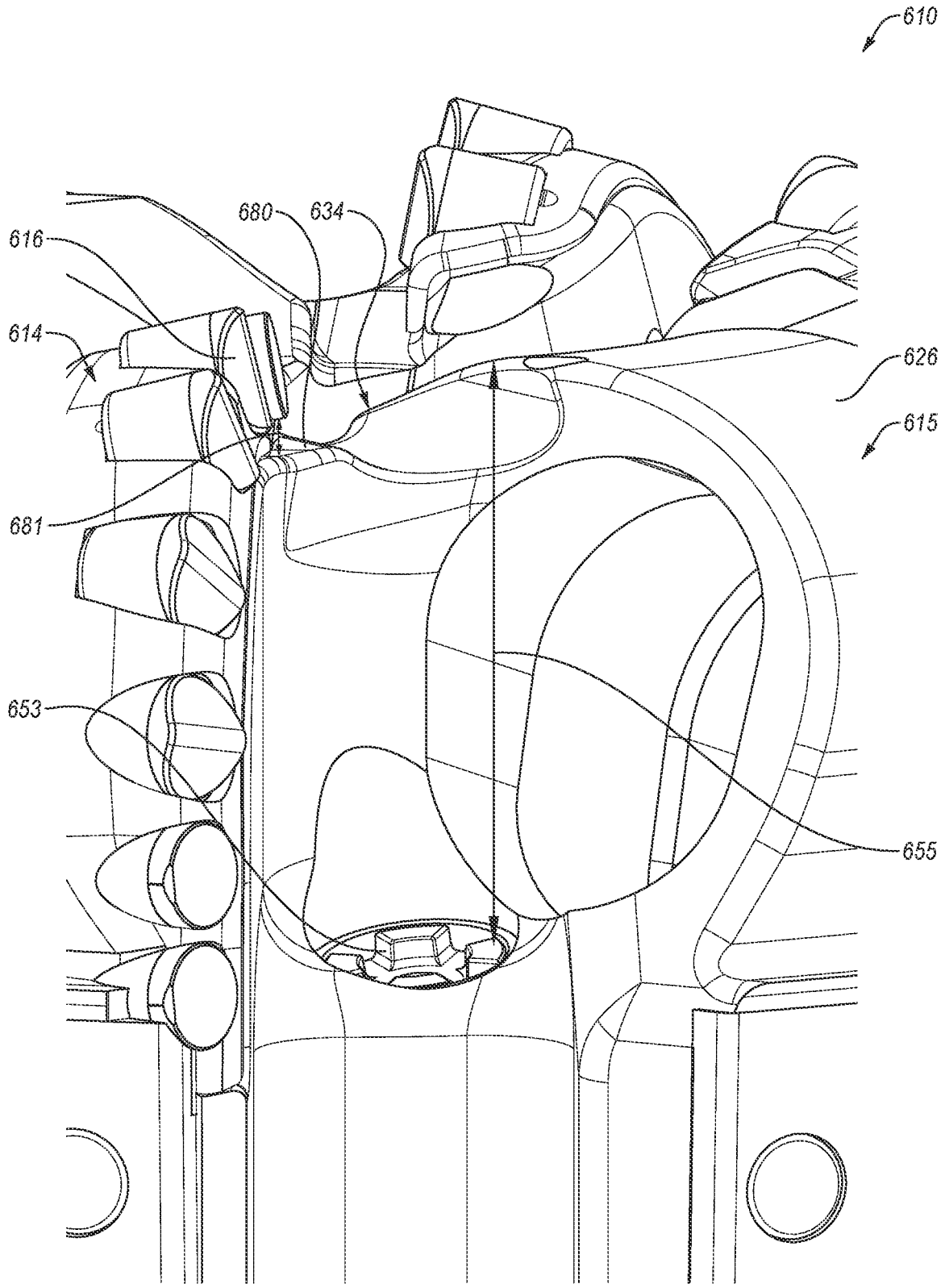
FIG. 6 is a representation of a side view of a hybrid bit, according to at least one embodiment of the present disclosure.

FIG. 6 is a representation of a side view of a portion of a bit 610, according to at least one embodiment of the present disclosure. In the embodiment shown, there is a saddle between a fixed blade 614 and a trailing support 626 of a wheel support structure 615. The saddle 634 may be the material that is located circumferentially between the fixed blade 614 and the wheel support structure 615. The saddle includes a saddle base 680 that is located a saddle distance 681 below a fixed blade cutting element 616. The saddle distance 681 may be the distance between the upholemost edge of the fixed blade cutting element. Thus, in the view shown, the saddle distance 681 is the distance from the lowest portion of the fixed blade cutting element to the saddle base 680. The saddle 634 extends in a radial direction and is arranged circumferentially between the fixed blade 614 and a radially inner portion of the trailing support 626.

In some embodiments, reducing the saddle distance 681 may increase the amount of material that is supporting the trailing support 626. This may help to reduce the deflection of the trailing support 626, which may, in turn, reduce the separation of the wheel (e.g., the wheel 218 of FIG. 2-1) from the leading support, thereby reducing or preventing infiltration of drilling fluid and/or other debris into the wheel support.

In some embodiments, the saddle distance 681 may be in a range having an upper value, a lower value, or upper and lower values including any of 0.1 in. (2.54 mm), 0.2 in. (5.08 mm), 0.3 in. (7.62 mm), 0.4 in. (10.2 mm), 0.5 in. (12.7 mm), 0.6 in. (15.2 mm), 0.7 in. (17.8 mm), 0.8 in. (20.3 mm), 0.9 in. (22.9 mm), 1.0 in. (25.4 mm), or any value therebetween. For example, the saddle distance 681 may be greater than 0.1 in (2.54 mm). In another example, the saddle distance 681 may be less than 1.0 in (25.4 mm). In yet other examples, the saddle distance 681 may be any value in a range between 0.1 in (2.54 mm) and 1.0 in (25.4 mm). In some embodiments, it may be critical that the saddle distance 681 is less than 0.5 in. (12.7 mm) to reduce the height of the trailing support, reduce its deflection, and maintain a seal between the wheel and the leading support. In some embodiments, it may be critical that the saddle distance 681 is less than 0.25 in. (6.4 mm) to reduce the height of the trailing support, reduce its deflection, and maintain a seal between the wheel and the leading support.

The bit 610 includes a wheel nozzle 653 that is located a wheel nozzle depth 655 below the trailing support 626. In some embodiments, the wheel nozzle depth 655 may be different from a depth of other nozzles on the bit 610 (such as the central nozzle 237 of FIG. 2-2) and/or a blade nozzle located near another blade on the bit 610 (such as a nozzle that leads the secondary blade 214-2 of FIG. 2-2). In some embodiments, the wheel nozzle depth 655 may be less than a wheel diameter of the wheel. In some embodiments, the wheel nozzle depth 655 may be in a range having an upper value, a lower value, or upper and lower values including any of 1.0 in. (2.54 cm), 1.2 in. (3.05 cm), 1.4 in. (3.56 cm), 1.6 in. (4.06 cm), 1.8 in. (4.57 cm), 2.0 in. (5.08 cm), 2.2 in. (5.59 cm), 2.4 in. (6.10 cm), 2.6 in. (6.60 cm), 2.8 in. (7.11 cm), 3.0 in. (7.62 cm), 3.5 in. (8.89 cm), 4.0 in. (10.2 cm), or any value therebetween. For example, the wheel nozzle depth 655 may be greater than 1.0 in. (2.54 cm). In another example, the wheel nozzle depth 655 may be less than 4.0 in. (10.2 cm). In yet other examples, the wheel nozzle depth 655 may be any value in a range between 1.0 in. (2.54 cm) and 4.0 in. (10.2 cm). In some embodiments, it may be critical that the wheel nozzle depth 655 is greater than the wheel diameter to flush cutting away from the wheel and/or the fixed blade 614. In some embodiments, it may be critical that the wheel nozzle depth 655 is less than the wheel diameter to reduce the saddle distance 681 of the primary fixed blade that trails the wheel nozzle 653 and to increase the strength of the trailing support 626. In some embodiments, the wheel nozzle depth 655 is between 10 to 50 percent of a depth of other nozzles of the bit that lead the secondary blades of the bit.

Figure 7:
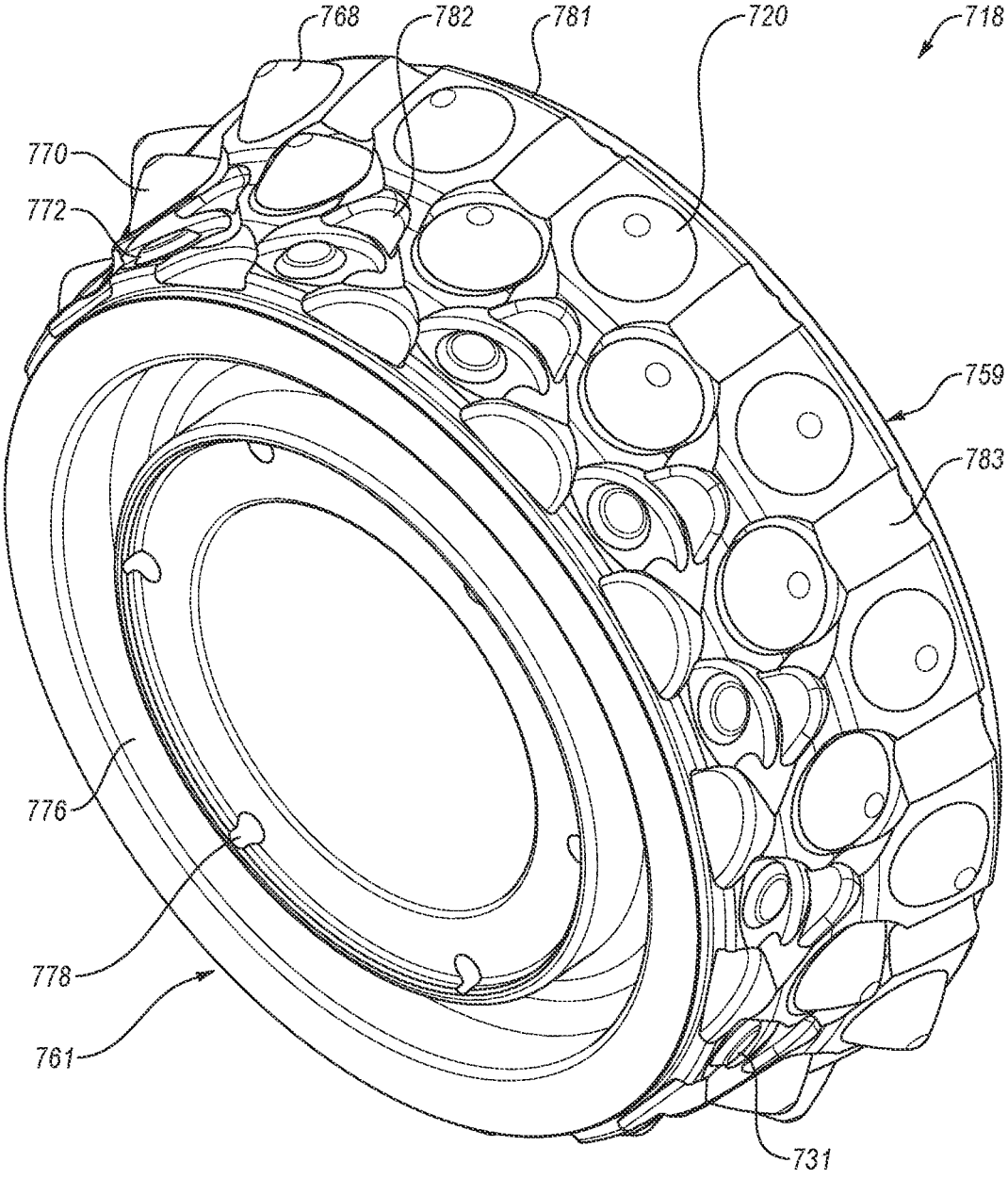
FIG. 7 is a representation of a perspective view of a wheel, according to at least one embodiment of the present disclosure.

FIG. 7 is a representation of a perspective view of a wheel 718, according to at least one embodiment of the present disclosure. The wheel 718 includes a plurality of wheel cutting elements 720. In some embodiments, the wheel cutting elements 720 may be organized into one or more rows of cutting elements. For example, in the embodiment shown, the wheel 718 includes a first row 768, a second row 770, and a third row 772 of cutting elements. The wheel 718 has a leading face 759 and a trailing face 761. The leading face 759 may be located rotationally ahead of the trailing face 761 as the wheel 718 rotates about a bit rotational axis (e.g., bit rotational axis 239 of FIG. 2-2) of a bit (e.g., bit 210 of FIG. 2-2).

As may be seen, the first row 768 and the second row 770 in the embodiment shown include conical wheel cutting elements 720, and the third row 772 includes planar or button wheel cutting elements 731. Thus, the wheel 718 may include different types of cutting elements. In some embodiments, the wheel 718 may include the same type of cutting elements.

The wheel 718 has a wheel body 781. As discussed above, the wheel diameter may differ between the leading face 759 and the trailing face 761, such that the rows 768, 770, 772 of cutting elements may be arranged at different distances from the wheel axis. In some embodiments, portions of the wheel body 781 may be removed. For example, a trailing portion 782 that is located rotationally behind (e.g., closer to the trailing face 761 than the leading face 759) wheel cutting elements 720 in the first row 768 and/or the second row 770 may be removed to prevent and/or reduce contact of the wheel body 781 with the formation during drilling. In some embodiments, a leading portion 783 that is located rotationally ahead (e.g., closer to the leading face 759 than the trailing face 761) of wheel cutting elements 720 in the second row 770 and/or the third row 772 may be removed to prevent and/or reduce contact of the wheel body 781 with the formation during drilling. In some embodiments, the trailing portion 782 and/or the leading portion 783 may be located between adjacent cutting elements on the same row.

In some embodiments, the first row 768 of wheel cutting elements may be the primary cutting elements (e.g., may cut or engage with the largest amount of the formation). In some embodiments, the second row 770 of wheel cutting elements may be the primary cutting elements (e.g., may cut or engage with the largest amount of the formation). In some embodiments, the first row 768 and the second row 770 may cut equal or approximately equal amounts of the formation. The portion of the formation cut by the first row 768 and/or the second row 770 of wheel cutting cuttings may be determined at least in part by an angular orientation of the wheel 718 with respect to the bit and/or the angle of the cutting elements in the respective rows with respect to the wheel 718. As discussed above, the wheel cutting elements may be the only cutting elements that engage with the formation near the bit axis and in the cone region of the bit.

The wheel 718 shown includes a seal gland 776 on a side-face of the wheel 718. A seal (e.g., seal 574 of FIG. 5) may be inserted into the seal gland 776 to provide a seal between the wheel 718 and the wheel support. The wheel 718 shown further includes a plurality of lubricant ports 778 that extend through the wheel body 781 to allow lubricant to travel through the wheel 718 from the leading face 759 to the trailing face 761. In the embodiment shown, the wheel 718 includes six lubricant ports 778. However, it should be understood that the wheel 718 may include any number of lubricant ports, including 1, 2, 3, 4, 5, 6, 7, 8, 9, 10, or more lubricant ports 778.

In some embodiments, the wheel 718 shown in FIG. 7 may be used in any wheel support structure (e.g., wheel support structure 215 of FIG. 2-1) on any bit (e.g., bit 210 of FIG. 2-1). In other words, the wheel 718 may be interchangeable with any other wheel on the same bit. In some embodiments, the wheel 718 may be interchangeable with any other wheel on any other bit. In some embodiments, different wheels 718 may be fabricated for different bits or different wheel support structures.

Figures 1, 8:
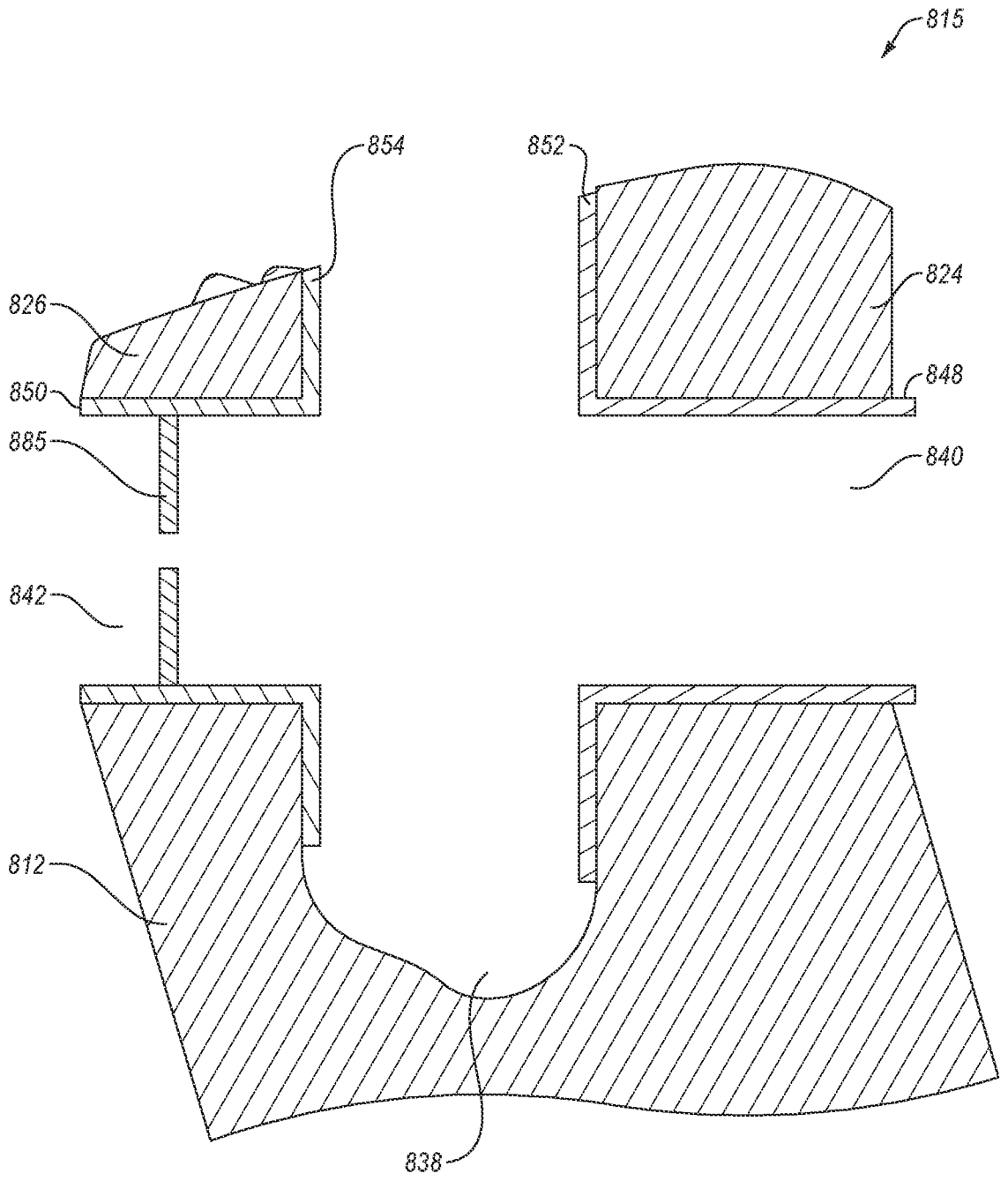
Figures 2, 8:
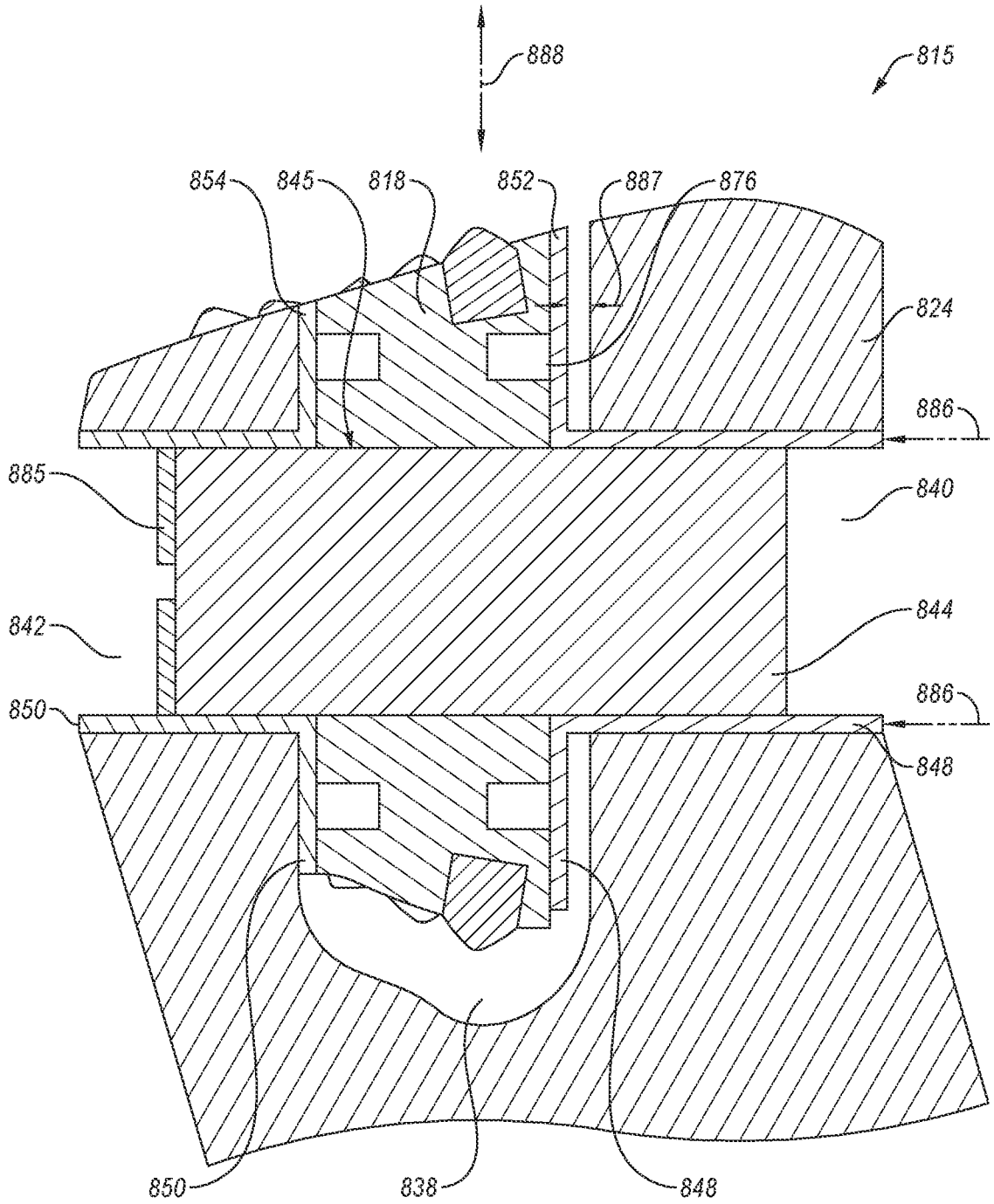
Figures 3, 8:
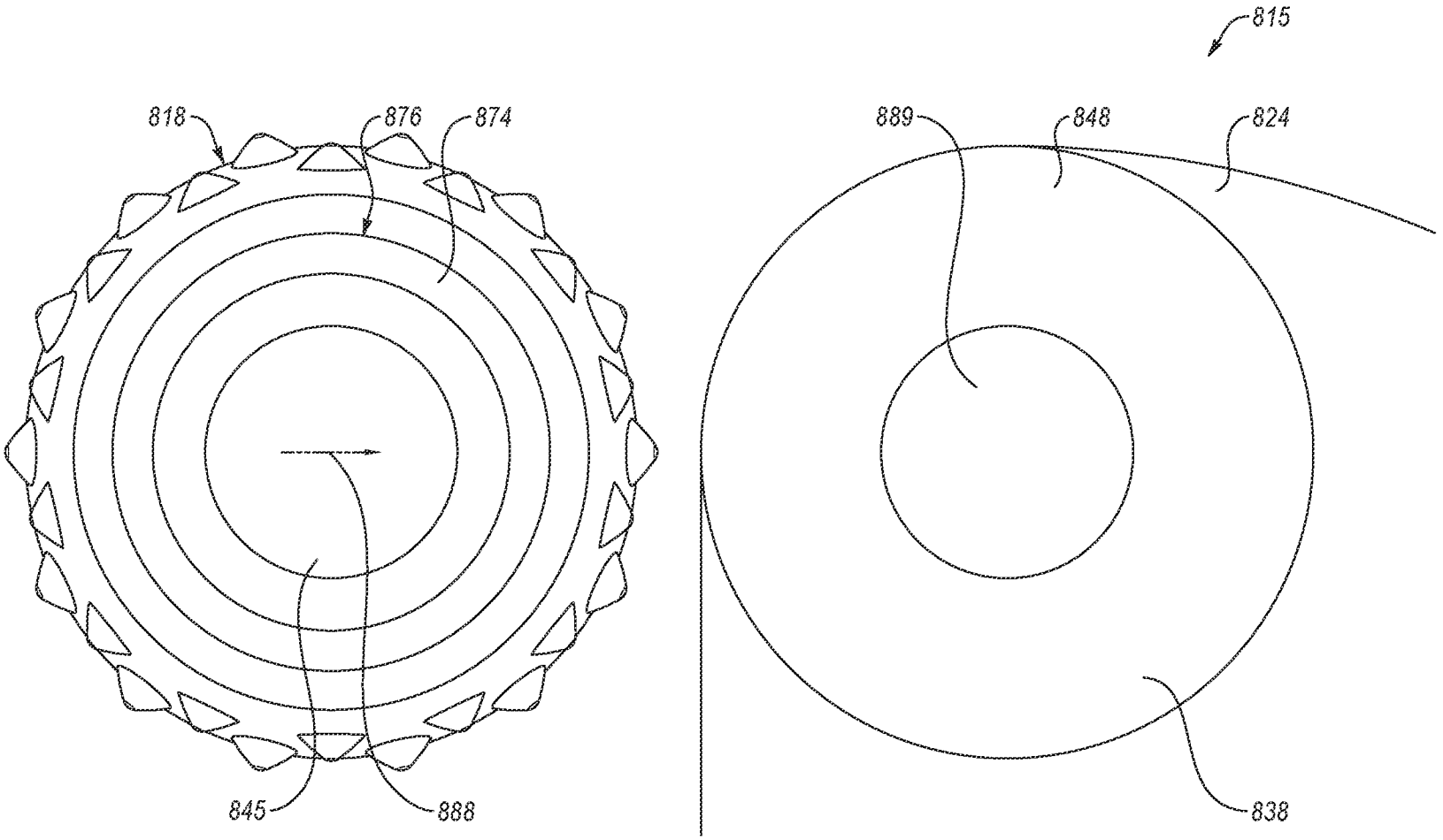
Figures 4, 8:
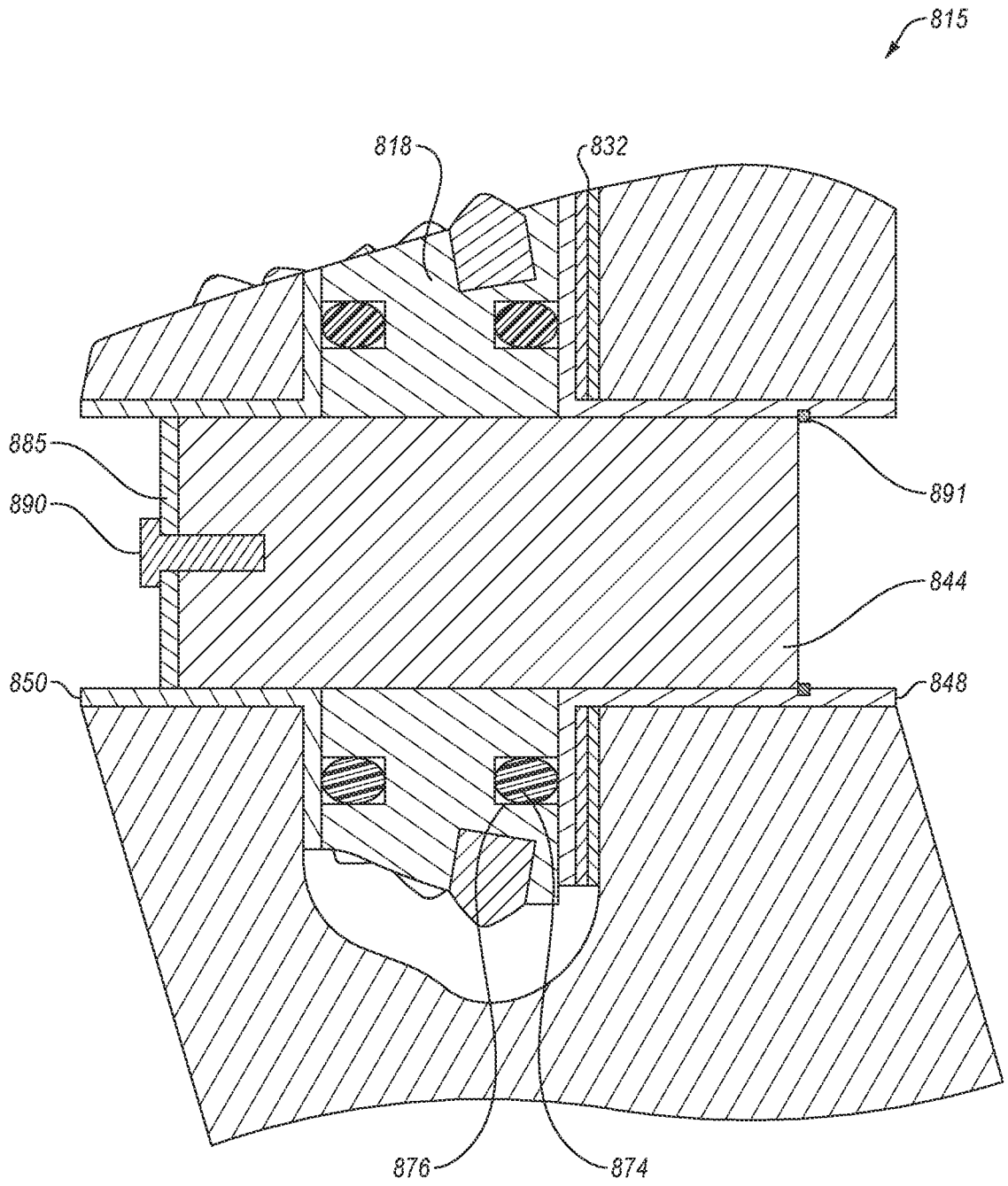

FIG. 8-1 through FIG. 8-4 are sequential representations of an assembly of a wheel support structure 815, according to at least one embodiment of the present disclosure. FIG. 8-1, FIG. 8-2, and FIG. 8-4 are representations of a cross section taken along line 1-1' in FIG. 2-2, and FIG. 8-3 is a representation of a cross section taken along line 2-2' in FIG. 2-4. It should be understood that, for clarity, only a portion of the bit (e.g., bit 210 of FIG. 2-2) is shown in FIG. 8-1 through FIG. 8-4). In FIG. 8-1, a bit body 812 (see, e.g., body 212 of FIG. 2-1) including the wheel support structure 815 has been provided. In some embodiments, the bit body 812 may be machined from a block of material. For example, the bit body 812 may be machined from block of steel. In some embodiments, the material of the bit body 812 may be any steel alloy. In some embodiments, the material of the bit body 812 may be 4130M steel alloy. 4130M steel is a high strength steel alloy. In some embodiments, the high strength steel alloy may increase the strength of the trailing support 826, thereby decreasing the deflection experienced by the trailing support 826.

The wheel support structure 815 includes a leading support 824 and the trailing support 826, which form a wheel slot 838 between them. The leading support 824 includes a leading journal bore 840 extending all the way through the leading support 824. The trailing support 826 includes a trailing journal bore 840 extending all the way through the trailing support 826. In some embodiments, the leading journal bore 840 may have a constant diameter through the leading support 824. In some embodiments, the leading journal bore 840 may have a diameter that changes through the leading support 824. For example, the leading journal bore 840 may be asymmetric relative to a wheel axis through the leading journal bore 840. In some embodiments, the trailing journal bore 842 may have a constant diameter through the trailing support 826. In some embodiments, the trailing journal bore 842 may have a diameter that changes through the trailing support 826. For example, the trailing journal bore 842 may be asymmetric relative to a wheel axis through the trailing journal bore 842. In the embodiment shown, the leading journal bore 840 and the trailing journal bore 842 do not have a common axis and do not intersect the bit rotational axis (e.g., bit rotational axis 239 of FIG. 2-2). Asymmetric and/or non-circular journal bores 840, 842 may reduce or eliminate rotation of the flanges 848, 850 during operation. In some embodiments, the leading journal bore 840 and the trailing journal bore 842 have a common axis, but do not intersect the bit rotational axis. However, it should be understood that, in some embodiments, the leading journal bore 840 and the trailing journal bore 842 may extend through a bit rotational axis.

To assemble the wheel support structure 815, a leading support flange 848 may be inserted into the leading journal bore 840 from the wheel slot 838. In other words, the leading support flange 848 may be inserted into the wheel slot 838, and then the leading support flange 848 may be inserted into the leading journal bore 840 until the leading flange support plate 852 contacts the leading support 824.

A trailing support flange 850 may be inserted into the trailing journal bore 842 from the wheel slot 838. In other words, the trailing support flange may be inserted into the wheel slot 838 and then the trailing support flange 850 may be inserted into the trailing journal bore 842 until the trailing flange support plate 854 contacts the trailing support 826.

In FIG. 8-2, a wheel 818 may be inserted into the wheel slot 838. In some embodiments, the wheel 818 may be inserted into the wheel slot 838 radially (e.g., into the page) relative to the bit. In some embodiments, the wheel 818 may be inserted into the wheel slot 838 longitudinally (e.g., up and down in longitudinal direction 884, the longitudinal direction 884 may be parallel to a bit rotational axis 239 of FIG. 2-2). In some embodiments, the wheel 818 may be inserted into the wheel slot 838 from a direction perpendicular to the bit rotational axis (e.g., into and out of the page in FIG. 8-2). In some embodiments, the wheel 818 may be inserted into the wheel slot 838 from any direction so as to seat the wheel 818 inside the wheel slot 838.

The wheel 818 may include one or more washers between the wheel and the leading support flange 848 and/or the trailing support flange 850. This may help with rotation of the wheel 818 during drilling operations. In some embodiments, the wheel may be aligned such that a wheel bore 845 of the wheel 818 may align with the leading journal bore 840 and the trailing journal bore 842.

A journal shaft 844 may be inserted into the leading journal bore 840, through the leading support flange 848, the wheel bore 845, and the trailing support flange 850 (in the trailing journal bore 842). In some embodiments, the journal shaft 844 may be inserted until it contacts a trailing support engagement wall 885. The engagement wall 885 may be configured to secure the journal shaft 844 to the trailing support flange 850. The engagement wall 885 may coupled to or formed with the trailing support flange 850. In some embodiments, a trailing end of the journal shaft 844 may be configured to mate with a complementary shaped feature of the trailing support flange 850. The complementary features may reduce or eliminate rotation of the journal shaft 844 relative to the trailing support flange 850. In some embodiments, a trailing end of the journal shaft 844 may have a hexagonal shape, a square shape, a rectangular shape, a triangular shape, an elliptical shape, or another shape that facilitates limited interfacing positions between the journal shaft 844 and the trailing support flange 850. The complementary features include one or more protrusions from the journal shaft 844 and one or more complementary recesses of the trailing support flange 850, one or more protrusions from the trailing support flange 850 and one or more complementary recesses of the journal shaft 844, or any combination thereof. The protrusions and/or recesses of the complementary features may be arranged such that approximately 20%, 30%, 40%, 50%, or 60% or more of the cross-sectional area of the journal shaft form the complementary features.

A biasing force 886 may be applied to one or both of the journal shaft 844 and the leading support flange 848. The biasing force 886 may be applied in the direction of rotation of the bit. In other words, the biasing force 886 may be applied from the leading support 824 to the trailing support 826. In some embodiments, the biasing force 886 may bias the trailing flange support plate 854 against the trailing support 826, bias the wheel 818 against the trailing support flange 850, and the leading support flange 848 against the wheel 818. In some embodiments, the biasing force 886 may be configured to elastically deflect the trailing support 824 according to a desired operational loading on the bit.

In some embodiments, the biasing force 886 may cause any gaps or other spaces between the elements of the wheel support structure 815 to be closed. This may cause the leading flange support plate 852 to move away from the leading support 824 with a separation distance 887. In some embodiments, at least a portion of the separation distance 887 may be determined by the manufacturing tolerances of the different elements of the wheel support structure 815. While individually small, changes in size due to manufacturing tolerances may add up such that the separation distance 887 may be too large for an effective seal. Thus, to fill in the gap between the leading flange support plate 852 and the leading support 824, one or more shims 832 may be installed around the leading support flange 848, as shown in FIG. 8-4.

To determine the separation distance 887, the width of the gap between the leading flange support plate 852 and the leading support 824 may be measured while the biasing force 886 is applied. In other words, during assembly of the wheel support structure 815, the separation distance 887 may be measured while the biasing force 886 is applied. In some embodiments, the separation distance 887 may be measured in a single location. In some embodiments, the separation distance 887 may be measured in multiple locations about the perimeter of the leading support 824. The separation distance 887 may be measured between a flange and an inner surface of the wheel slot 838.

It should be noted that, during the assembly steps described in relation to FIG. 8-2, the seals 874 (see FIG. 8-4) have not been installed in the glands 876. The seals 874 may have a height that is greater than a depth of the glands 876. To reduce the size of the biasing force 886 used to determine the separation distance 887, the seals 874 are left out of the glands 876 until after the wheel 818 is removed to install the shims 832 on the leading support flange 848.

After the separation distance 887 is determined, the journal shaft 844 is removed, the wheel 818 is removed, and the leading support flange 848 is removed. Based on the size of the separation distance 887, one or more shims 832 are selected to install around the leading support flange 848, between the leading flange support plate 852 and the leading support 824. In some embodiments, no more than two shims 832 may be used to fill the separation distance 887.

In some embodiments, the wheel 818 may again be installed in the wheel slot 838 according to the embodiments shown in FIG. 8-1 and FIG. 8-2 (e.g., without the seals 874 installed in the glands 876) while including the installed shims 832. A technician may determine if the wheel 818 may be rolled by hand. If the wheel 818 may be rolled by hand, then installation may continue as shown in FIG. 8-3 and FIG. 8-4. If the wheel 818 may not be rolled by hand, then the width of the shims may be reduced by an assembly test distance (such as 0.001 in. (25.4 μm)), and then checked again if able to be rolled by hand.

FIG. 8-4 is a cut-away view of the wheel 818 being installed in the wheel support structure 815. In the embodiment shown, the shims 832 have been installed on the leading support flange 848 and the leading support flange installed in the leading support 824. A seal 874 has been installed in the seal gland 876 of the wheel 818. The wheel 818 may further be assembled with various support elements, including washers and sleeves located in the wheel bore 845. Each of these elements may be lubricated, and lubricant may be installed in the lubricant ports (e.g., lubricant ports 578 of FIG. 5).

The wheel 818 may be inserted into the wheel slot 838 in the radial direction 888 (e.g., using a radial force applied in the radial direction 888). To facilitate installation of the wheel 818 without damaging the seal 874, a plug 889 may be installed in the leading support flange 848 and in the trailing support flange 850. Compressing the seals 874 into the glands 876, the wheel may be inserted radially into the wheel slot 838. The seals 874 may slide along the leading support flange and the plug 889 until the wheel is completely installed in the wheel slot 838. When the wheel 818 is in place, the plug 889 may be removed.

After the plug 889 has been removed from both the leading support flange 848 and the trailing support flange 850, the journal shaft 844 may be installed, as shown in FIG. 8-4. The journal shaft 844 may be secured inside the trailing support flange 850 using a journal bolt 890 inserted into the journal shaft 844 through the trailing support engagement wall. The journal shaft 844 may further be secured inside the leading support flange 848 using a snap ring 891. In some embodiments, a cover may be at least partially installed in the leading journal bore 840 to retain and/or isolate the journal shaft 844 from the outer surface of the leading support 824. FIG. 2-1 illustrates the cover 221. The cover 221 may at least partially cover the leading support flange. A journal bolt 290 may secure the cover to the journal or to the leading support flange.

Figure 9:
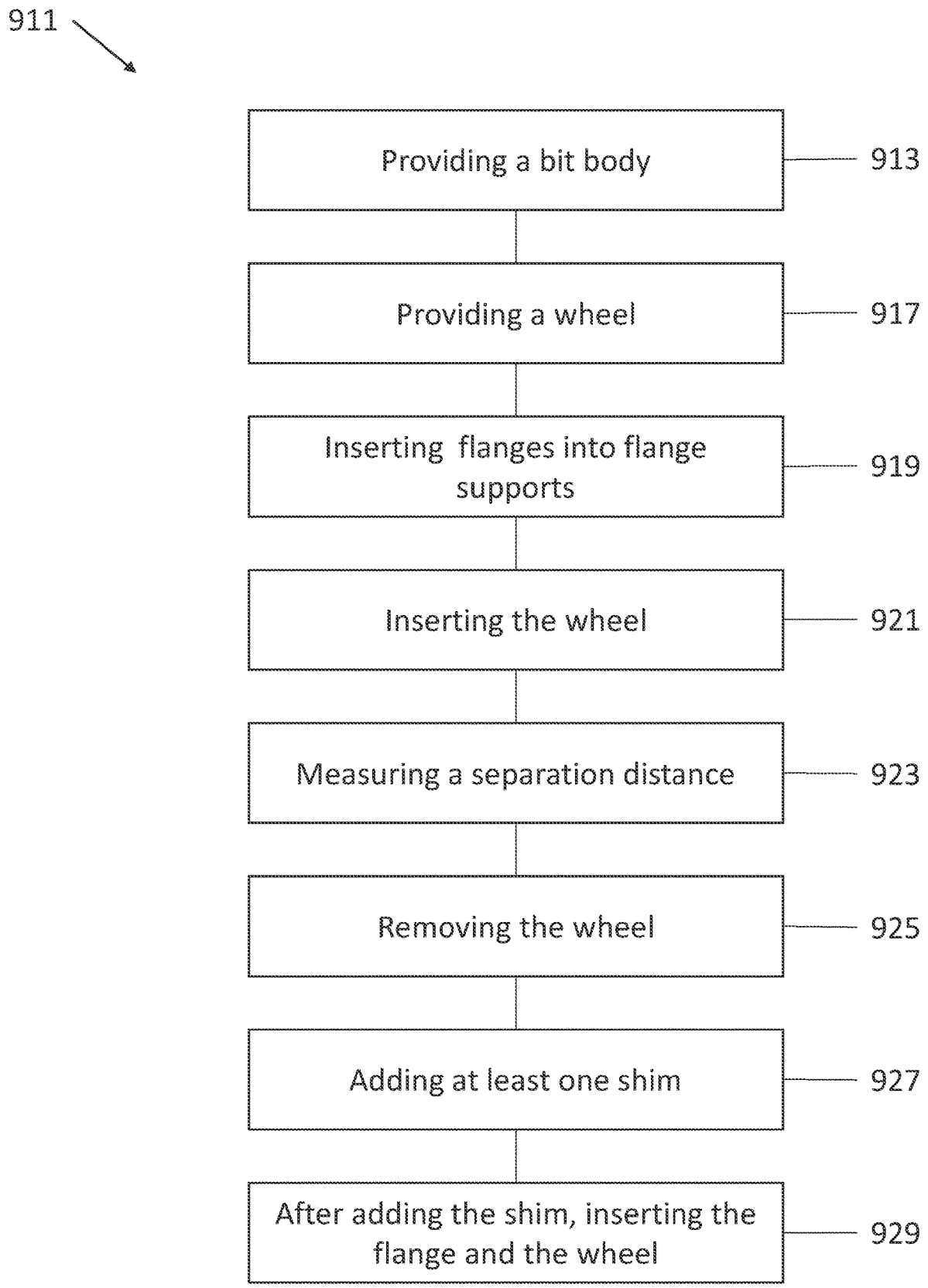
FIG. 9 is a representation of a method for assembling a bit, according to at least one embodiment of the present disclosure.

FIG. 9 is a representation of a method 911 for assembling a bit, according to at least one embodiment of the present disclosure. In accordance with embodiments of the present disclosure, the method 911 may be represented by FIG. 8-1 through 8-4 and the associated description.

The method 911 includes providing a bit body at 913. The bit body may include one or more fixed blades and a wheel mount. The wheel mount may include a leading support and a trailing support. The leading support and the trailing support may define a wheel slot between them. A wheel may be provided at 917. The wheel may include one or more cutting elements along an outer surface of the wheel. In some embodiments, providing the bit body and/or providing the wheel may include any mechanism used to provide the bit body and/or the wheel. For example, providing these elements may include manufacturing, machining, smelting, sintering, purchasing, procuring, receiving, any other type of providing, and combinations thereof. In some embodiments, the bit body and/or the wheel may be provided immediately prior to performing the other acts of the method 911. In some embodiments, the bit body and/or the wheel may be manufactured by the same group that assembles the bit. In some embodiments, the bit body and/or the wheel may be manufactured by a different group than assembles the bit and purchased and/or otherwise acquired as pre-fabricated units.

The method 911 may include inserting a leading flange into the leading support and inserting a trailing flange into the trailing support at 919. A wheel may then be inserted into the wheel slot between the leading support and the trailing support at 921. A separation distance between the wheel and/or the leading flange and the leading support may then be measured 923. To facilitate measuring of the separation distance, a biasing force may be applied to the leading flange and/or the wheel to push the wheel and the leading flange toward the trailing support.

After the separation distance has been measured, the wheel and the leading flange may be removed at 925. At least one shim may be added to the leading flange at 927. After adding the shim, the flange and the wheel may be re-inserted into the wheel slot at 929. Another method 911 may include measuring the wheel slot, measuring the thicknesses of the components and geometric out of tolerance values without inserting the wheel and flange, determining the appropriate thicknesses of shims from the measurements of the wheel slot, thickness, and tolerance values, then inserting the flange, shims, and wheel.

The embodiments of the hybrid bit have been primarily described with reference to wellbore drilling operations; the hybrid bit described herein may be used in applications other than the drilling of a wellbore. In other embodiments, hybrid bits according to the present disclosure may be used outside a wellbore or other downhole environment used for the exploration or production of natural resources. For instance, hybrid bits of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for manufacturing a bit, comprising:

providing a bit body, the bit body including a fixed blade and a wheel support structure, the wheel support structure defining a wheel slot;

providing a wheel, the wheel including a plurality of cutting elements;

inserting a first flange into the wheel support structure;

inserting the wheel into the wheel slot;

with the wheel in the wheel slot, measuring a separation distance between the first flange and the wheel support structure;

removing the wheel from the wheel slot and the first flange from the wheel support structure;

adding at least one shim to the wheel support structure, the at least one shim having a shim width less than or equal to the separation distance; and after adding the at least one shim, inserting the first flange into the wheel support structure and the wheel into the wheel slot.

2. The method of claim 1, wherein the wheel includes a seal gland, and comprising inserting an elongated seal into the seal gland, wherein the elongated seal contacts the first flange when the wheel is inserted into the wheel slot.

3. The method of claim 2, comprising inserting the elongated seal includes inserting the elongated seal after removing the wheel from the wheel slot.

4. The method of claim 1, wherein the wheel includes a wheel body, the plurality of cutting elements being attached to the wheel body, wherein providing the wheel includes removing material from the wheel body in a cutting path of the plurality of cutting elements.

5. The method of claim 1, wherein providing the bit body includes providing the bit body from 4130M alloy and machining the bit body to include the wheel slot.

6. The method of claim 1, wherein inserting the wheel into the wheel slot includes inserting the wheel into the wheel slot from a radial direction.

7. The method of claim 1, comprising, before measuring the separation distance, applying a biasing force to the wheel to bias the wheel toward a trailing surface of the wheel support structure.

8. A hybrid bit, comprising a plurality of fixed blades;

a first support including a first journal bore;

a second support including a second journal bore, the first journal bore being aligned with the second journal bore, wherein the first support and the second support define a wheel slot;

a slot base extending to a central nozzle in the wheel slot, wherein the central nozzle is disposed at a bit axis of the hybrid bit;

a first flange inserted into the first journal bore;

a shim between the first flange and the first journal bore;

a wheel located between the first support and the second support, the wheel including a seal gland; and an elongated seal located in the seal gland.

9. The hybrid bit of claim 8, wherein the elongated seal has an exposure of between 0.035 in. (0.889 mm) and 0.100 in. (2.03 mm).

10. The hybrid bit of claim 8, wherein the elongated seal has a seal width to height percentage of between 30% and 100%.

11. The hybrid bit of claim 8, wherein the shim fills a separation between the first flange and the first support.

12. The hybrid bit of claim 8, wherein the seal gland has a durometer that changes along a seal height.

13. The hybrid bit of claim 8, wherein the wheel slot has a wheel slot depth that is greater than or equal to a wheel diameter of the wheel.

14. The hybrid bit of claim 8, comprising a wheel nozzle arranged between the second support and a fixed blade of the plurality of fixed blades that rotationally trails the second support, wherein a wheel nozzle depth below the second support to the wheel nozzle is less than a central nozzle depth below the second support to the central nozzle.

15. The hybrid bit of claim 8, comprising:

a fixed blade nozzle arranged between the first support and a first fixed blade of the plurality of fixed blades that rotationally leads the first support, wherein the fixed blade nozzle is disposed a fixed nozzle depth below the first support to the fixed blade nozzle; and a wheel nozzle arranged between the second support and a second fixed blade of the plurality of fixed blades that rotationally trails the second support, wherein a wheel nozzle depth below the second support to the wheel nozzle is less than the fixed nozzle depth.

16. A hybrid bit, comprising:

a plurality of fixed blades;

a first support including a first journal bore;

a second support including a second journal bore, the first journal bore being aligned with the second journal bore, the first support and the second support defining a wheel slot;

a wheel located between the first support and the second support in the wheel slot, wherein the wheel comprises a cutting element, the cutting element having a tip; and a slot base extending to a central nozzle in the wheel slot, wherein the slot base is offset from the tip of the cutting element with an offset of less than 0.50 in. (12.7 mm), wherein, at a central nozzle, the wheel slot has a wheel slot depth that is greater than or equal to a wheel diameter of the wheel.

17. The hybrid bit of claim 16, wherein the offset is a first offset, and wherein the wheel comprises:

a rotational axis;

a first row of cutting elements having a first tip distance from the rotational axis, wherein the first tip distance extends to the tip of the cutting element, the first row of cutting elements comprises the cutting element, and wherein the slot base is offset from the first row of cutting elements by the first offset; and a second row of cutting elements having a second tip distance from the rotational axis, the second tip distance being less than the first tip distance, and wherein the slot base is offset from the second row of cutting elements by a second offset, the second offset being less than 0.5 in. (12.7 mm).

18. The hybrid bit of claim 17, wherein the first row of cutting elements and the second row of cutting elements are conical.

19. The hybrid bit of claim 16, wherein the slot base comprises a slot base profile, the slot base profile being arcuate.

* * * * *